US007375467B2

(12) United States Patent
Hur et al.

(10) Patent No.: US 7,375,467 B2
(45) **Date of Patent: *May 20, 2008**

(54) PLASMA DISPLAY PANEL HAVING STEPPED ELECTRODE STRUCTURE

(75) Inventors: Min Hur, Suwon-si (KR); Hyea-Weon Shin, Suwon-si (KR); Hoon-Young Choi, Suwon-si (KR); Sang-Geon Park, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 1 day.

This patent is subject to a terminal disclaimer.

(21) Appl. No.: 11/282,264

(22) Filed: Nov. 18, 2005

(65) Prior Publication Data

US 2006/0108926 A1 May 25, 2006

(30) Foreign Application Priority Data

Nov. 19, 2004 (KR) ..... 10-2004-0095003

(51) Int. Cl.
*H01J 17/49* (2006.01)

(52) U.S. Cl. ..... 313/584; 313/495; 313/496; 313/497; 313/491; 345/66

(58) Field of Classification Search ..... 313/584, 313/585, 582, 581, 567, 306
See application file for complete search history.

(56) References Cited

U.S. PATENT DOCUMENTS 5,541,618 A * 7/1996 Shinoda ..... 345/60
5,661,500 A * 8/1997 Shinoda et al. ..... 345/60
5,663,741 A * 9/1997 Kanazawa ..... 345/66
5,674,553 A * 10/1997 Shinoda et al. ..... 427/68
5,724,054 A * 3/1998 Shinoda ..... 345/60
5,786,794 A * 7/1998 Kishi et al. ..... 345/60
5,952,782 A * 9/1999 Nanto et al. ..... 313/584
RE37,444 E * 11/2001 Kanazawa ..... 345/67
6,630,916 B1 * 10/2003 Shinoda ..... 345/60
6,707,436 B2 * 3/2004 Setoguchi et al. ..... 345/60

* cited by examiner

*Primary Examiner*—Sikha Roy
*Assistant Examiner*—Brian T Schoolman
(74) *Attorney, Agent, or Firm*—Christie, Parker & Hale, LLP

(57) ABSTRACT

A plasma display panel in which a sustain discharge is generated as an opposed discharge, thereby reducing a discharge firing voltage and improving efficiency. The plasma display panel includes first and second substrates. Address electrodes are formed on the first substrate in a first direction and first electrodes and second electrodes are formed in a second direction crossing the first direction. Each of the first electrodes and the second electrodes has base portions that correspond to discharge spaces of discharge cells and a crossbar portion that connects the base portions along the second direction. The base portions of the first and the second electrodes face each other across a gap in each discharge cell. The length of the portions of the base portions near the first substrate is different from that of the portions of the base portions near the second substrate in the second direction.

20 Claims, 22 Drawing Sheets

PLASMA DISPLAY PANEL HAVING STEPPED ELECTRODE STRUCTURE

CROSS-REFERENCE TO RELATED APPLICATION

This application claims priority to and the benefit of Korean Patent Application No. 10-2004-0095003 filed in the Korean Intellectual Property Office on Nov. 19, 2004, the entire content of which is incorporated herein by reference.

BACKGROUND OF THE INVENTION

1. Technical Field

The present invention relates to a plasma display panel, and more particularly, to a plasma display panel in which a sustain discharge can be induced by an opposed discharge.

2. Related Art

Generally, a plasma display panel (PDP) is a display device in which vacuum ultraviolet (VUV) rays emitted from plasma by gas discharge excite phosphors to generate visible light, thereby creating images. Such a plasma display panel having a high-resolution large screen has been in the spotlight as a next-generation thin display device.

In the structure of the plasma display panel, a three-electrode surface-discharge structure is generally used. The plasma display panel having the three-electrode surface-discharge structure includes a front substrate that has display electrodes, each including two electrodes, and a rear substrate that is spaced apart from the front substrate at a predetermined distance and includes address electrodes. A space between the substrates is divided into a plurality of discharge cells by barrier ribs. In each discharge cell, a phosphor layer is formed on the rear substrate. Discharge gas is injected into the discharge cells.

Whether or not a discharge is generated is determined by an address discharge between one of the two electrodes of the display electrode and an opposing address electrode. A sustain discharge that controls luminance is generated by two electrodes in the display electrode that are disposed on the same surface. That is, in conventional plasma display panels, the address discharge is induced by an opposed discharge and the sustain discharge is induced by a surface discharge.

Though the distance between the display electrode and the address electrode is larger than the distance between the display electrodes, a discharge firing voltage of the address discharge is smaller than a discharge firing voltage of the sustain discharge. It has been known that, since the address discharge is induced by an opposed discharge, the discharge firing voltage of the address discharge is smaller than that of the sustain discharge which is induced by a surface discharge. Accordingly, it can be seen that a plasma display panel capable of generating the sustain discharge by an opposed discharge has higher efficiency than the conventional plasma display panel.

A discharge space in a display panel is divided into a sheath region and a positive column region by the discharge generated in the plasma display panel. The sheath region is a non-light-emitting region, which is formed to surround the electrode or the dielectric layer and in which most of voltage is consumed. The positive column region is a region in which the plasma discharge is quickly generated by a very small voltage. Accordingly, in order to increase the efficiency of the plasma display panel, it is important to enlarge the positive column region. Because the length of the sheath region is not related to the discharge gap, the discharge length may be increased to enlarge the positive column region. However, if the discharge gap is enlarged to extend the discharge length, a problem is created in that the required discharge firing voltage is increased.

As such, in the conventional plasma display panel, a low discharge firing voltage and a high efficiency cannot be achieved simultaneously.

SUMMARY

A plasma display panel that can generate a sustain discharge between display electrodes by an opposed discharge to reduce a discharge firing voltage is provided.

The plasma display panel has an increased main discharge length to enhance discharge efficiency, while having a firing discharge with a small discharge gap to reduce a discharge firing voltage.

In one embodiment of the present invention, a plasma display panel includes first and second substrates that are disposed to face each other at a predetermined distance, a space between the substrates that is divided into a plurality of discharge cells, and phosphor layers that are formed in the respective discharge cells. Address electrodes are formed on the first substrate in a first direction and first electrodes and second electrodes are formed in a second direction crossing the first direction. The first and second electrodes are electrically isolated from the address electrodes and each discharge cell includes an electrode of each type.

The first electrodes and the second electrodes have base portions that correspond to discharge spaces of the respective discharge cells and a crossbar portion that connects the base portions along the second direction. The base portions of the first electrodes and the base portions of the second electrodes may face each other across gaps the discharge cells. The length of the portions of the base portions near the first substrate may be different from that of the portions of the base portions near the second substrate in the second direction. The length of the portions of the base portions near the first substrate may be longer or shorter than that of the portions of the base portions near the second substrate in the second direction. Further, the portions of the base portions near the first substrate may protrude toward the center of each discharge cell more than the portions of the base portions facing the second substrate.

In the plasma display panel according to one embodiment of the present invention, each of the base portions of the first set of electrodes and the second set of electrodes may include at least two electrode layers having different lengths in the first direction and/or the second direction.

The electrode layers may become longer or shorter stepwise toward the first substrate in the second direction. The electrode layers may protrude more toward the center of each discharge cell stepwise in the direction of the first substrate from the second substrate.

With respect to the sections of the electrode layers taken along a direction parallel to the first substrate, an electrode layer close to the first substrate may be wider than an electrode layer close to the second substrate.

DETAILED DESCRIPTION

Figure 1:
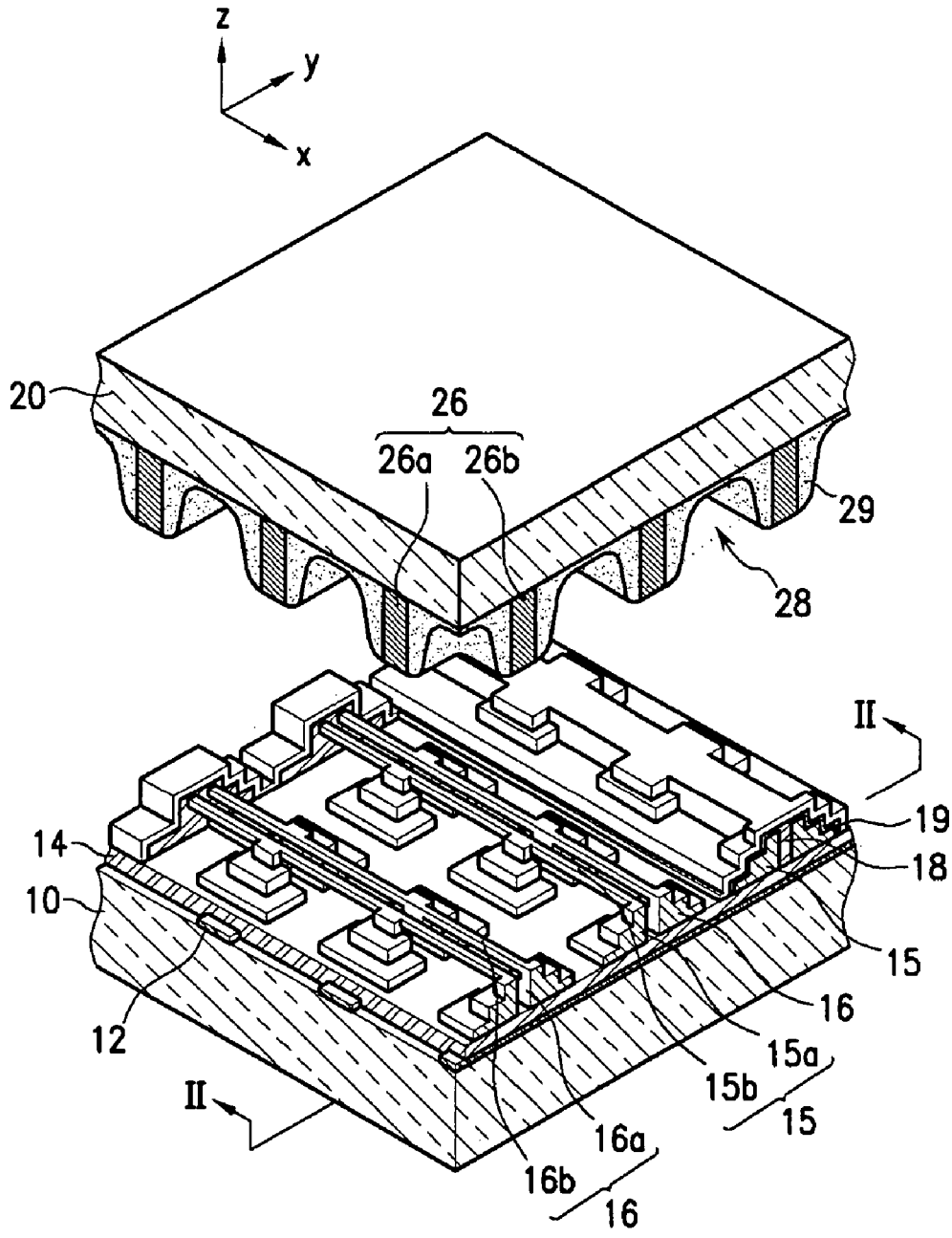
FIG. 1 is a partially exploded perspective view showing a plasma display panel according to a first embodiment of the present invention.
Figure 2:
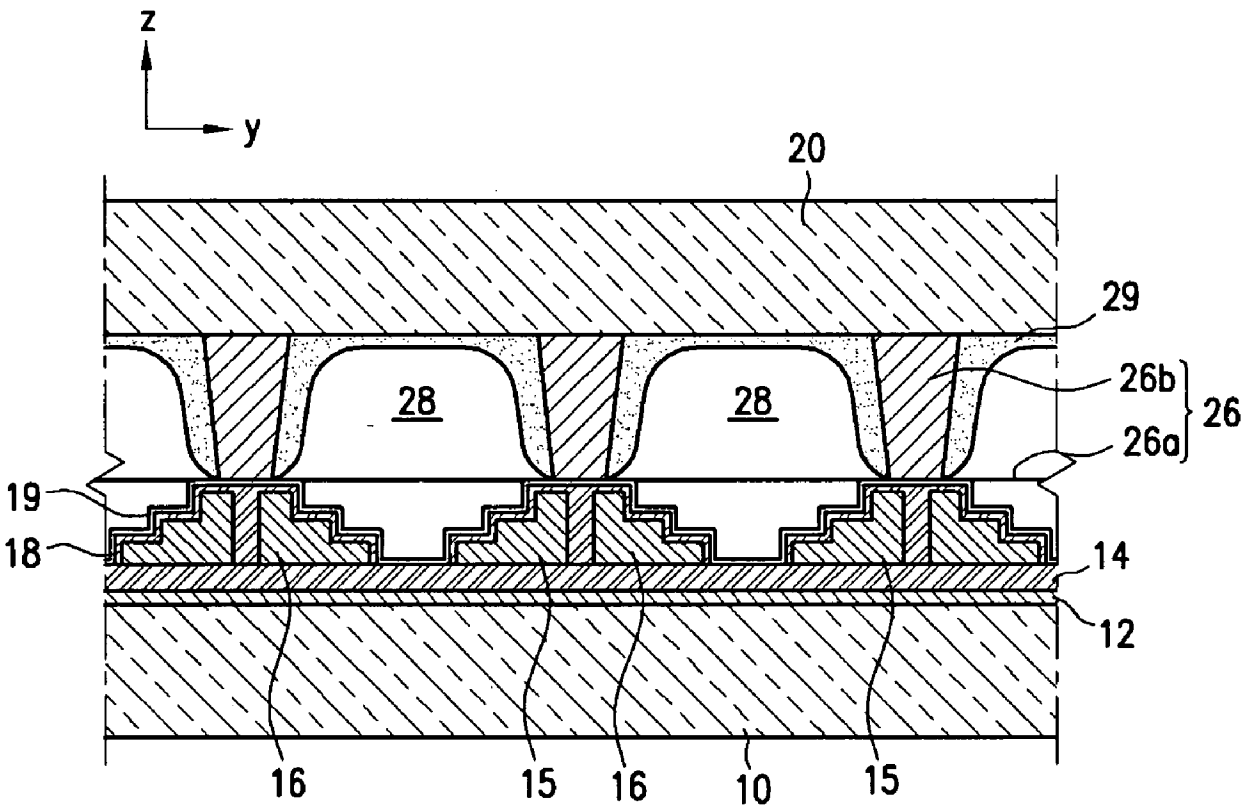
FIG. 2 is a partial cross-sectional view taken along the line II-II of FIG. 1.
Figure 3:
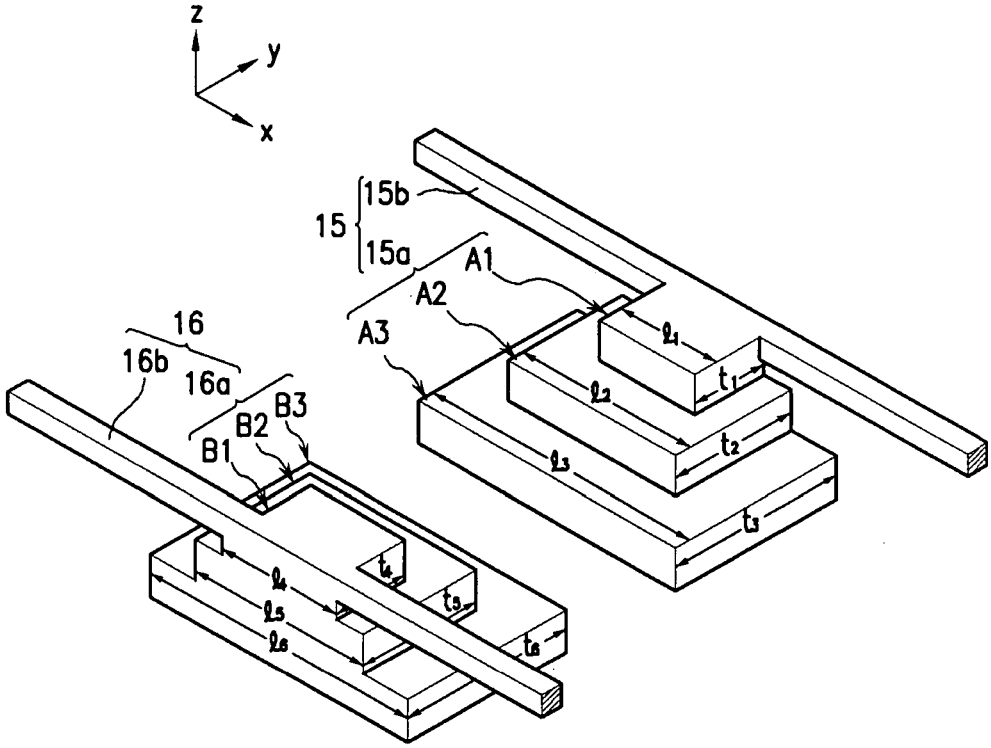
FIG. 3 is a partial perspective view showing a first electrode and a second electrode that correspond to a discharge cell in the first embodiment of the present invention.
Figure 4:
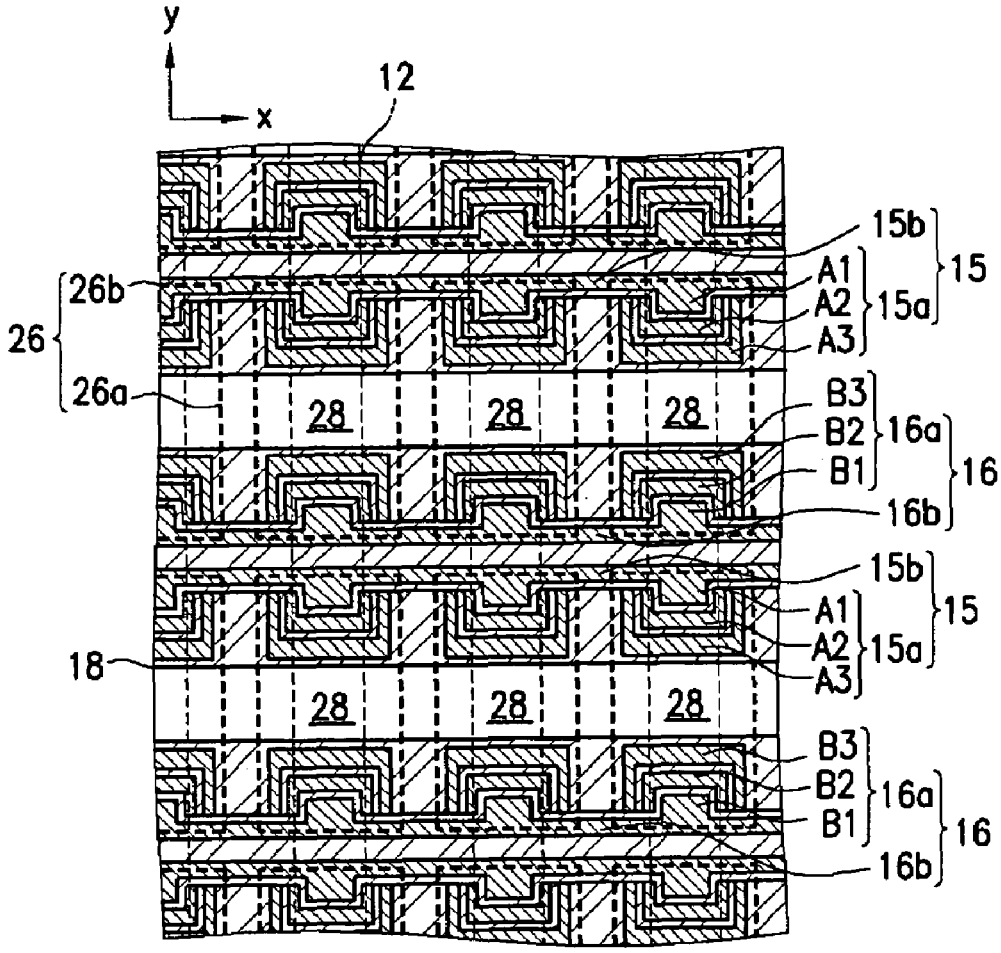
FIG. 4 is a partial plan view showing the plasma display panel according to the first embodiment of the present invention.

Hereinafter, plasma display panels according to embodiments of the present invention will be described with reference to the drawings. FIG. 1 is a partially exploded perspective view showing a plasma display panel according to a first embodiment of the present invention. FIG. 2 is a partial cross-sectional view taken along the line II-II of FIG. 1. FIG. 3 is a partial perspective view showing a first electrode and a second electrode corresponding to each discharge cell in the first embodiment of the present invention. FIG. 4 is a partial plan view showing the plasma display panel according to the first embodiment of the present invention.

Referring to FIGS. 1 and 2, in the plasma display panel according to the first embodiment of the present invention, a rear substrate 10 and a front substrate 20, each having a predetermined size, are disposed substantially in parallel with each other with a predetermined gap between them. A space between the rear substrate 10 and the front substrate 20 is divided into a plurality of discharge cells 28 by barrier ribs 26.

The barrier ribs 26 are formed on a surface of the front substrate 20 opposite the rear substrate 10 to define the discharge cells 28. The barrier ribs 26 include a first set of barrier rib members 26*a* that are formed along a first direction (in the drawing, a y-axis direction) and a second set of barrier rib members 26*b* that are formed along a second direction (in the drawing, an x-axis direction) to cross the first set of barrier rib members 26*a*.

The barrier rib structure of the present invention is not limited to the above-described structure. A stripe-shaped barrier rib structure, which includes only barrier rib members formed along the first direction, can be applied to the present invention. In another embodiment, various other types of barrier rib structures for dividing and defining the discharge cells can be applied to the present invention.

In one embodiment of the present invention, a dielectric layer (not shown) may be formed on the front substrate 20 and then the barrier ribs 26 may be formed on the dielectric layer. This configuration also falls within the scope of the embodiments of present invention.

Red, blue, and green phosphor layers 29, which absorb ultraviolet rays and in response emit visible light, are formed in each of the discharge cells 28. A discharge gas, for example, xenon (Xe), neon (Ne), or similar gases, is filled into the respective discharge cells 28 to be used to create a plasma discharge. In the present embodiment, in each discharge cell 28, the phosphor layer 29 is formed on the side surfaces of the barrier ribs 26 and the bottom surface near the front substrate 20 between the barrier ribs 26.

Address electrodes 12 are formed along the first direction on a surface of the rear substrate 10 opposite the front substrate 20. A first dielectric layer 14 is formed on the entire surface of the rear substrate 10 to cover the address electrodes 12. In one embodiment, the address electrodes 12 have stripe shapes with uniform line widths.

On the first dielectric layer 14, first electrodes 15 and second electrodes 16 are formed along the second direction and are electrically isolated from the address electrodes 12 by the first dielectric layer 14. In the present embodiment, the first electrodes 15 and the second electrodes 16 correspond to discharge cells 28. In a pair of adjacent discharge cells 28 along a first direction, the first electrodes 15 and the second electrodes 16 are disposed in an alternating order. For example, a first electrode 15 may be followed by a second electrode 16, then a first electrode 15, and finally a second electrode 16.

The first electrodes 15 are involved in an address discharge during an address period, together with the corresponding address electrodes 12. The second electrodes 16 are involved in a sustain discharge during a sustain period together with the first electrodes 15. That is, the first electrodes 15 function as scan electrodes and the second electrodes 16 function as sustain electrodes. The electrodes are not limited to the above-described functions and may perform functions different from the above-described functions depending on a signal voltage applied.

The first electrode 15 and the second electrode 16 include base portions 15*a* or 16*a*, respectively, that correspond to each discharge space of each discharge cell 28, and a crossbar portion 15*b* and 16*b*, respectively, that connects the base portions 15*a* and 16*a* along the second direction.

The base portion 15*a* of the first electrode 15 and the base portion 16*a* of the second electrode 16 face each other with a space there between in each discharge cell 28. The first electrode 15 and the second electrode 16 are formed to face each other in each discharge cell 28, and thus the sustain discharge between the first electrode 15 and the second electrode 16 can be induced as an opposed discharge. Therefore, as compared to the conventional plasma display panel in which the sustain discharge is induced as a surface discharge, the discharge firing voltage of the sustain discharge can be reduced.

A portion of each of the base portions 15*a* and 16*a* of the first and second electrodes 15 and 16 near the rear substrate 10 protrudes more toward the center of each discharge cell 28 than other portions of the base portions 15*a* and 16*a* of the first and second electrodes 15 and 16. The length of base portions 15*a* and 16*a* of the first and second electrodes 15 and 16 in the first direction becomes gradually larger toward the rear substrate 10.

Further, the length of the portions of the base portions 15*a* and 16*a* near the rear substrate 10 is longer than that of the portions of the base portions 15*a* and 16*a* near the front substrate 20 in the second direction.

In one embodiment, as shown in FIG. 3, the base portion 15*a* is made of a laminate including at least two of the electrode layers A1, A2 and A3, which each have a different length and width. The base portion 16*a* is made of a laminate including at least two of the electrode layers B1, B2, and B3, which each have a different length and width. The respective electrode layers A1, A2, and A3, and B1, B2, and B3 are formed to be in physical contact with each other and to be electrically connected to each other. In one embodiment, the crossbar portions 15*b* and 16*b* respectively connect the electrode layers A1 and B1, which are disposed near the front substrate 20.

As shown in FIG. 3, the base portion 15*a* includes the electrode layer A1 which is close to the front substrate 20, the electrode layer A3 which is disposed close to the rear substrate 10, and the electrode layer A2 which is disposed between the electrode layer A1 and the electrode layers A3. Similarly, the base portion 16*a* includes the electrode layer B1 which is close to the front substrate 20, the electrode layer B3 which is disposed close to the rear substrate 10, and the electrode layer B2 which is disposed between the electrode layer B1 and the electrode layers B3. However, the embodiments of the present invention are not limited to this configuration. The embodiments of the present invention may be varied to include all permutations of the use of at least two electrode layers.

The electrode layers A1, A2, and A3, and B1, B2, and B3 in the base portions 15*a* and 16*a* of the first and second electrodes 15 and 16 are further described below.

The base portion 15*a* of the first electrode 15 may be structured so that $I_2$ is larger than $I_1$ and $I_3$ is larger than $I_2$. Here, $I_1$, $I_2$, and $I_3$ are the lengths of the electrode layer A1, the electrode layer A2, and the electrode layer A3 of the base portion 15*a* of the first electrode 15 which are measured along the second direction (e.g., the x-axis), respectively. The base portion 16*a* of the second electrode 16 may also be structured so that $I_5$ is larger than $I_4$ and $I_6$ is larger than $I_5$. Here, $I_4$, $I_5$, and $I_6$ are the lengths of the electrode layer B1, the electrode layer B2, and the electrode layer B3 of the base portion 16*a* of the second electrode 16 which are measured along the second direction, respectively.

The length of the base portions 15*a* and 16*a* of the first and second electrodes 15 and 16 in the second direction increases stepwise or incrementally from the electrode layers A1 and B1 that are close to the front substrate 20 to the electrode layers A3 and B3 that are close to the rear substrate 10. If all the electrode layers A1, A2, and A3, and B1, B2, and B3 are formed, a cross-section of the base portions 15*a* and 16*a* taken along the direction perpendicular to the first direction has a step shape in which the length increases stepwise from the electrode layers A1 and B1 that are close to the front substrate 20 to the electrode layers A3 and B3 that are close to the rear substrate 10.

The base portion 15*a* of the first electrode 15 may be structured so that $t_2$ is larger than $t_1$ and $t_3$ is larger than $t_2$. Here, $t_1$, $t_2$, and $t_3$ are widths of the electrode layer A1, the electrode layer A2, and the electrode layer A3 of the base portion 15*a* of the first electrode 15 in the first direction (e.g., the y-axis). The base portion 16*a* of the second electrode 16 may be structured so that $t_5$ is larger than $t_4$ and $t_6$ is larger than $t_5$. Here, $t_4$, $t_5$, and $t_6$ are widths of the electrode layer B1, the electrode layer B2, and the electrode layer B3 of the base portion 16*a* of the second electrode 16 in the first direction.

The width of the base portions 15*a* and 16*a* of the first and second electrodes 15 and 16 in the first direction increases in a stepwise or incremental fashion from the electrode layers A1 and B1, which are close to the front substrate 20, to the electrode layers A3 and B3, which are close to the rear substrate 10. If all the electrode layers A1, A2, and A3, and B1, B2, and B3 are formed, the cross-section of the base portions 15*a* and 16*a* along the direction perpendicular to the second direction has a step shape in which the width increases stepwise from the electrode layers A1 and B1, which are close to the front substrate 20, to the electrode layers A3 and B3, which are close to the rear substrate 10.

Accordingly, the sections of the electrode layers A1, A2 and A3 and B1, B2, and B3 taken along the direction parallel to the substrates 10 and 20 are formed to be progressively wider from the electrode layers A1 and B1 to the electrode layers A3 and B3. The first and second electrodes 15 and 16 having this shape can be easily manufactured by a printing method or similar method.

In one embodiment of the invention, the base portions may have a different number of electrode layers. The lengths and widths of the corresponding layers of the first and second electrodes may be different. These alternative embodiments also fall within the scope of the present invention.

Referring again to FIGS. 1 and 2, a second dielectric layer 18 is formed to surround the first and second electrodes 15 and 16. Referring to FIG. 4, in one embodiment, the second dielectric layer 18 is formed to extend along the second direction while surrounding the first and second electrodes 15 and 16, such that a discharge space is formed between the first and second electrodes 15 and 16. Because the first and second electrodes 15 and 16 are divided up and assigned to corresponding discharge cells 28, erroneous discharge is not caused.

FIG. 4 is a plan view showing the first and second electrodes 15 and 16 and the second dielectric layer 18 covering the sections of the respective electrode layers A1, A2, and A3, and B1, B2, and B3 of the first and second electrodes 15 and 16 along the direction parallel to the substrates 10 and 20. The second dielectric layer 18 is shown from different perspectives in FIGS. 1 and 2.

Returning to FIG. 1, an MgO protective film 19 is formed on the entire surface of the rear substrate 10 to cover the first dielectric layer 14 and the second dielectric layer 18. The MgO protective film 19 prevents the first dielectric layer 14 and the second dielectric layer 18 from being damaged due to the collision of ions that are created at the time of the plasma discharge. The MgO protective film 19 has high secondary electron emission coefficient, and thus, the MgO protective film 19 increases the discharge efficiency.

As described above, in one embodiment, all the address electrodes 12, the first electrodes 15 and the second electrodes 16 involved in the discharge are formed on the rear substrate 10.

Because all the address electrodes 12 and the first electrodes 15 involved in the address discharge are formed on the rear substrate 10, the path of the address discharge can be reduced and thus the discharge firing voltage of the address discharge can be reduced. In addition, because the phosphor layers 29 are formed on the front substrate 20, inconsistency in the discharge firing voltage between the phosphor layers 29 of different colors having different dielectric constants can be prevented.

Because all the electrodes 12, 15, and 16 involved in the discharge are not disposed on the front substrate 20, the transmittance of visible light generated by the plasma discharge can be enhanced. Further, because the first and second electrodes 15 and 16 are made of only metal electrodes having superior conductivity, the manufacturing processes can be simplified and the manufacturing cost can be reduced, in comparison to the conventional plasma display panel that has transparent electrodes and metal electrodes.

Figure 5:
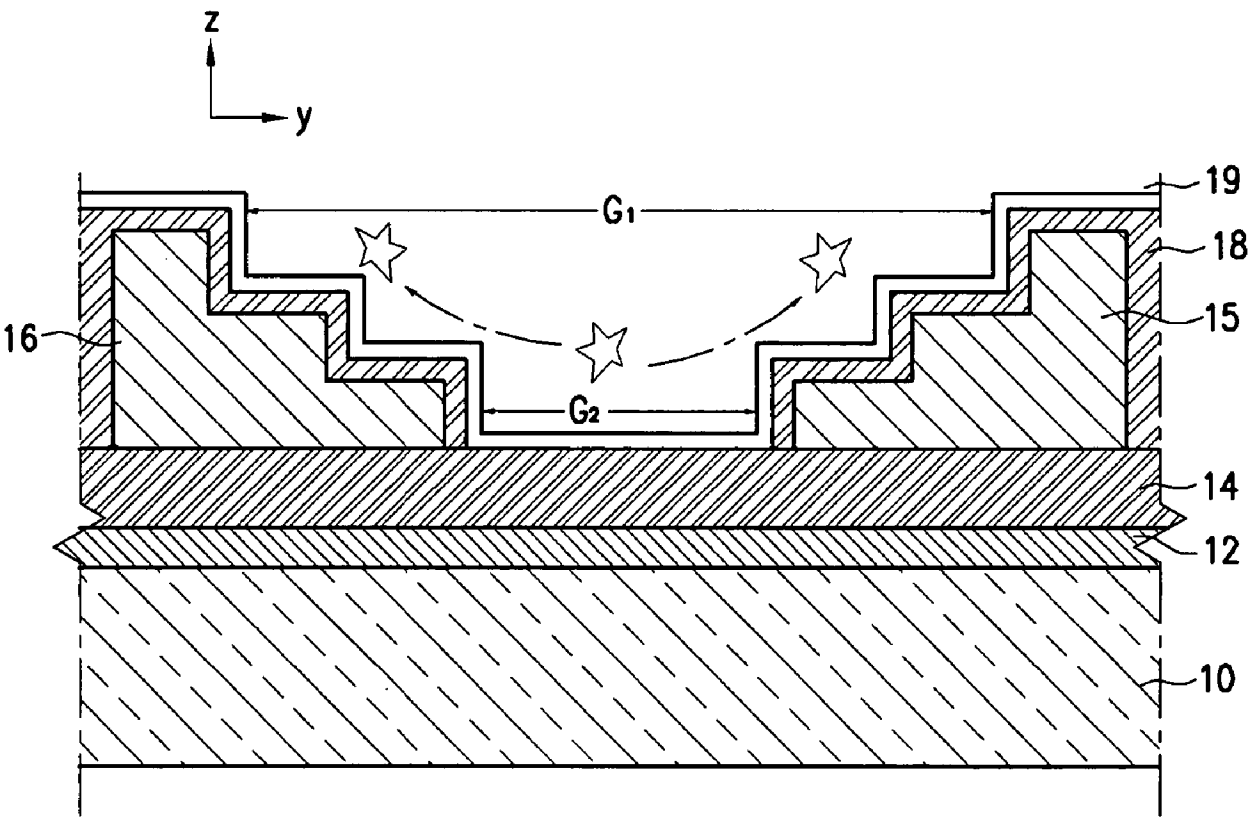
FIG. 5 is a partial cross-sectional view showing a rear plate of the plasma display panel according to the first embodiment of the invention.

The discharge of such a plasma display panel will be described with reference to FIG. 5. FIG. 5 is a partial cross-sectional view showing a rear plate of the plasma display panel according to a first embodiment of the present invention. The rear plate refers to as the rear substrate 10 on which the address electrodes 12, the first and second electrodes 15 and 16 and so on are formed.

In the first embodiment, the first and second electrodes 15 and 16 protrude further toward each other near the rear substrate 10 than near the front substrate 20. Therefore, a short gap G2 is formed between the first electrode 15 and the second electrode 16 near the rear substrate 10 and a long gap G1 is formed between the two electrodes near the front substrate. As a result, as shown in FIG. 5, the discharge is fired across the short gap G2 near the rear substrate 10 and is diffused across the long gap G1 on the front substrate 20.

In the first embodiment, because the discharge is fired across the short gap G2 near the rear substrate 10, the discharge firing voltage can be reduced. Generally, the larger the area of the electrode is, the lower the discharge firing voltage is. In the first embodiment, the first and second electrodes 15 and 16 are formed so that the areas of the electrode layers become larger toward the rear substrate 10. As a result, the discharge firing voltage can be further reduced.

Because a main discharge is created between the electrode layers near the front substrate 20 having the long gap, the discharge length can be increased and thus the discharge efficiency can be enhanced. Generally, the larger the area of the electrode is, the greater the amount of current that flows in the electrode is. Therefore, as the area of the electrode layers facing the front substrate 20 that are not involved in firing the discharge is decreased, the amount of discharge current can be limited.

Hereinafter, modifications of the first embodiment of the present invention will be described. The modifications of the first embodiment are based on the same basic configuration as that of the first embodiment and include many of the same parts as the first embodiment, which are represented by the same reference numerals in the accompanying drawings.

Figure 6:
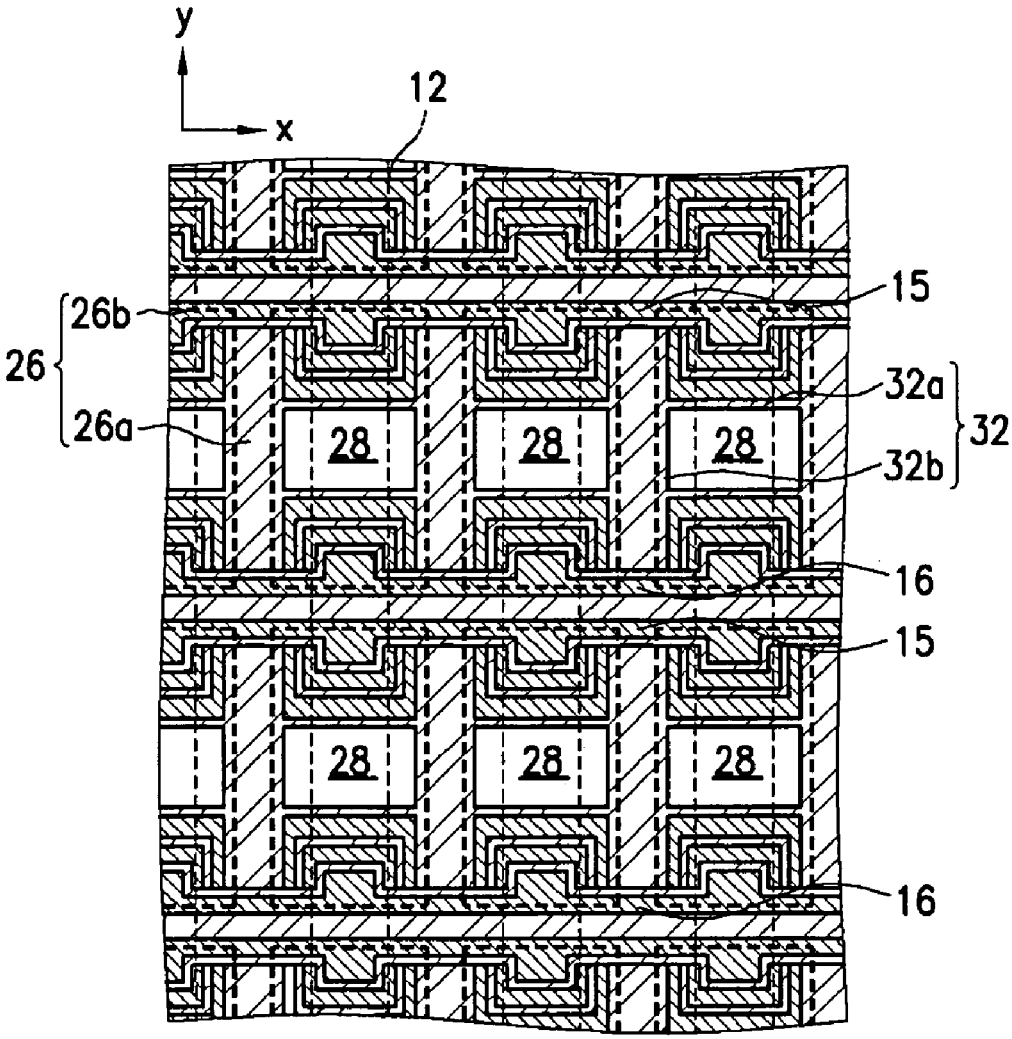
FIG. 6 is a partial plan view showing a first modification of the first embodiment of the present invention.

FIG. 6 is a partial plan view showing a first modification of the first embodiment of the present invention. Referring to FIG. 6, in the first modification, a second dielectric layer 32 includes a first dielectric layer portion 32*a* that is formed along the second direction to surround the first and second electrodes 15 and 16 and a second dielectric layer portion 32*b* that is formed along the first direction. The second dielectric layer portion 32*b* is formed along the lines corresponding to the first barrier rib members 26*a*.

In the first modification, because the second dielectric layer 32 includes the second dielectric layer portion 32*b*, the discharge cells 28 can be separated from one another with greater independence. Accordingly, the discharge of the respective discharge cells 28 can be controlled more accurately.

Figure 7:
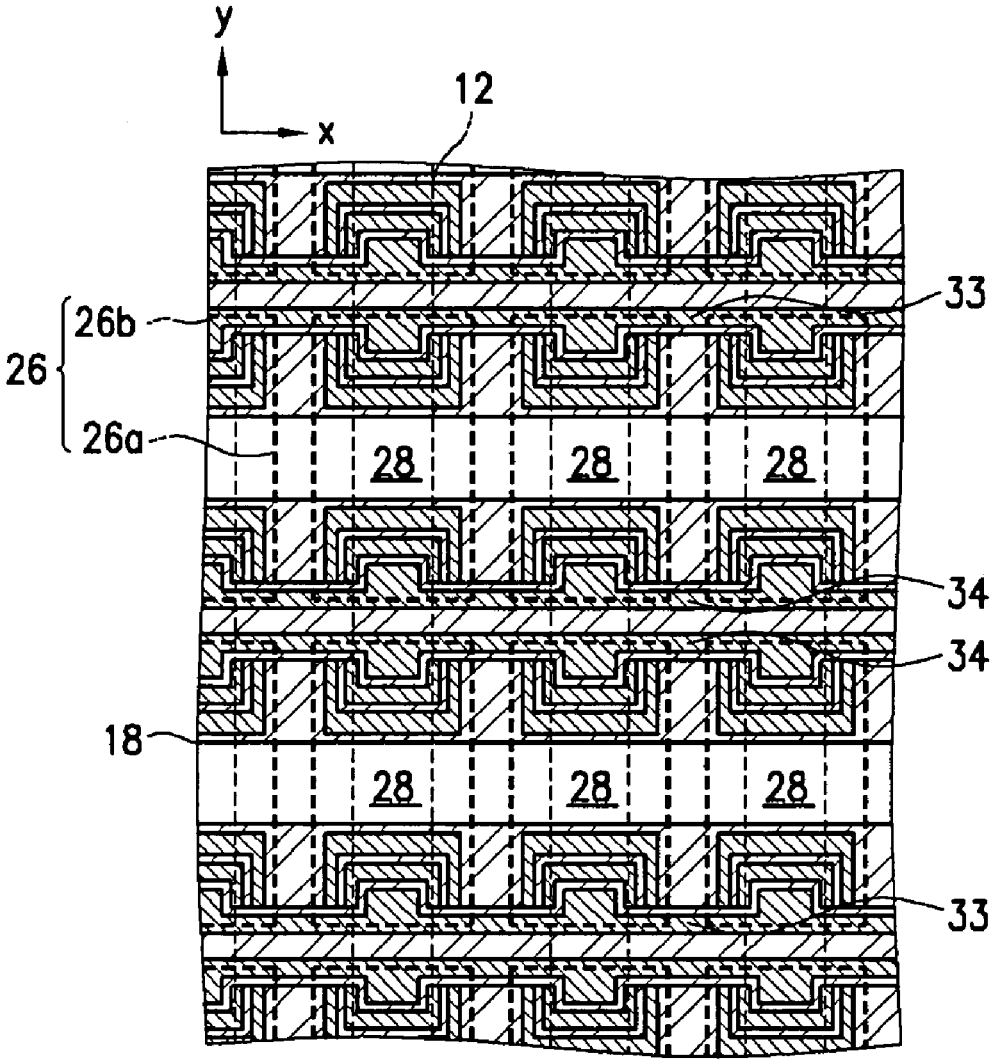
FIG. 7 is a partial plan view showing a second modification of the first embodiment of the present invention.

FIG. 7 is a partial plan view showing a second modification of the first embodiment of the present invention. In the second modification, first electrodes 33 function as scan electrodes and second electrodes 34 function as sustain electrodes. The first electrodes 33 and the second electrodes 34 are disposed in pairs in adjacent discharge cells 28, however the order of the electrodes in a first direction does not alternate. For example, the order may be a first electrode 33, a second electrode 34, another second electrode 34, and then a first electrode 33. The arrangement of a scan electrode-sustain electrode pair and a sustain electrode-scan electrode pair in adjacent discharge cells 28 is repeated.

Figure 8:
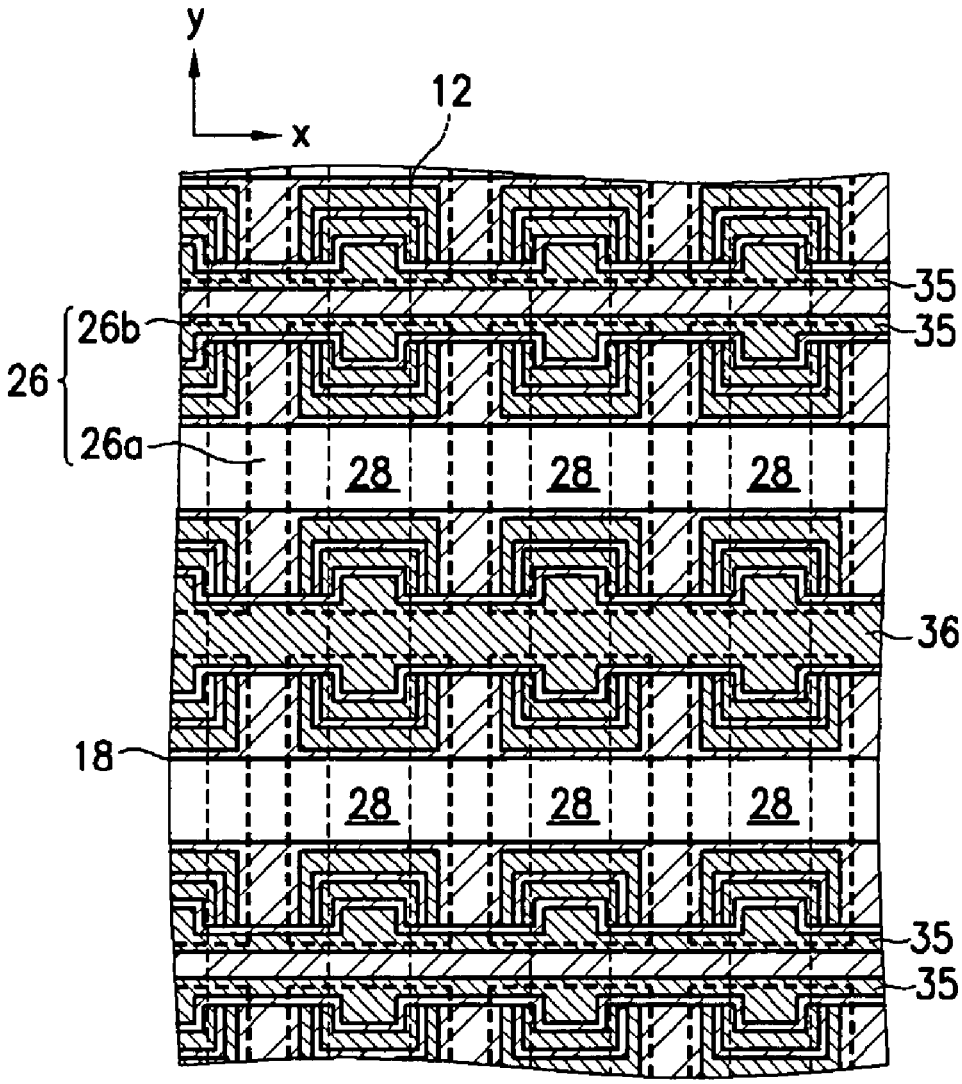
FIG. 8 is a partial plan view showing a third modification of the first embodiment of the present invention.

FIG. 8 is a partial plan view showing a third modification of the first embodiment of the present invention. As shown in FIG. 8, in the third modification, a second electrode 36 is formed to be shared by a pair of adjacent discharge cells 28 in the first direction. Thus, the arrangement of electrodes may be a first electrode 35, then a second electrode 36, and a first electrode 35 is formed in a pair of adjacent discharge cells 28 in the first direction. This arrangement may be sequentially repeated in the first direction. In a plasma display panel according to the third modification, for example, the address discharge is caused by applying a voltage to the first electrode 35 and the address electrode 12 and the sustain discharge is caused by applying a voltage to the first electrode 35 and the second electrode 36.

Figure 9:
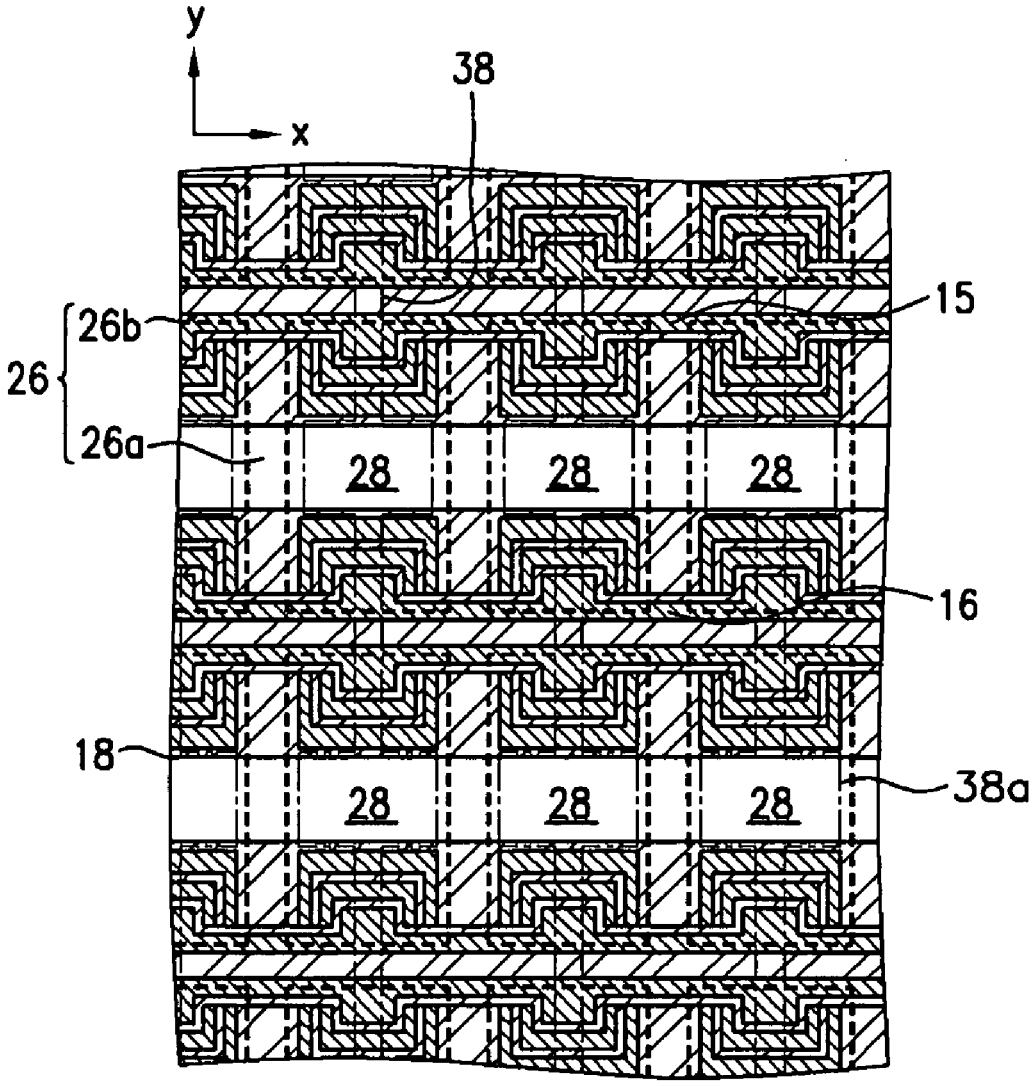
FIG. 9 is a partial plan view showing a fourth modification of the first embodiment of the present invention.

FIG. 9 is a partial plan view showing a fourth modification of the first embodiment of the present invention. As shown in FIG. 9, in the fourth modification, a protruding portion 38*a* is formed in a portion of an address electrode 38 corresponding to a space between the first electrode 15 and the second electrode 16. The protruding portion 38*a* extends outward along the second direction from both sides of the address electrode 38.

In the fourth modification, the area of a portion of the address electrode 38 below the first electrode 15 and the second electrode 16 is reduced and the area of the portion of the address electrode 38 corresponding to the space between the first electrode 15 and the second electrode 16 is enlarged. Accordingly, the portion of the address electrode 38 not involved in the address discharge is minimized and the portion involved in the address discharge is enlarged, such that the efficiency of the address discharge is enhanced.

Figure 10:
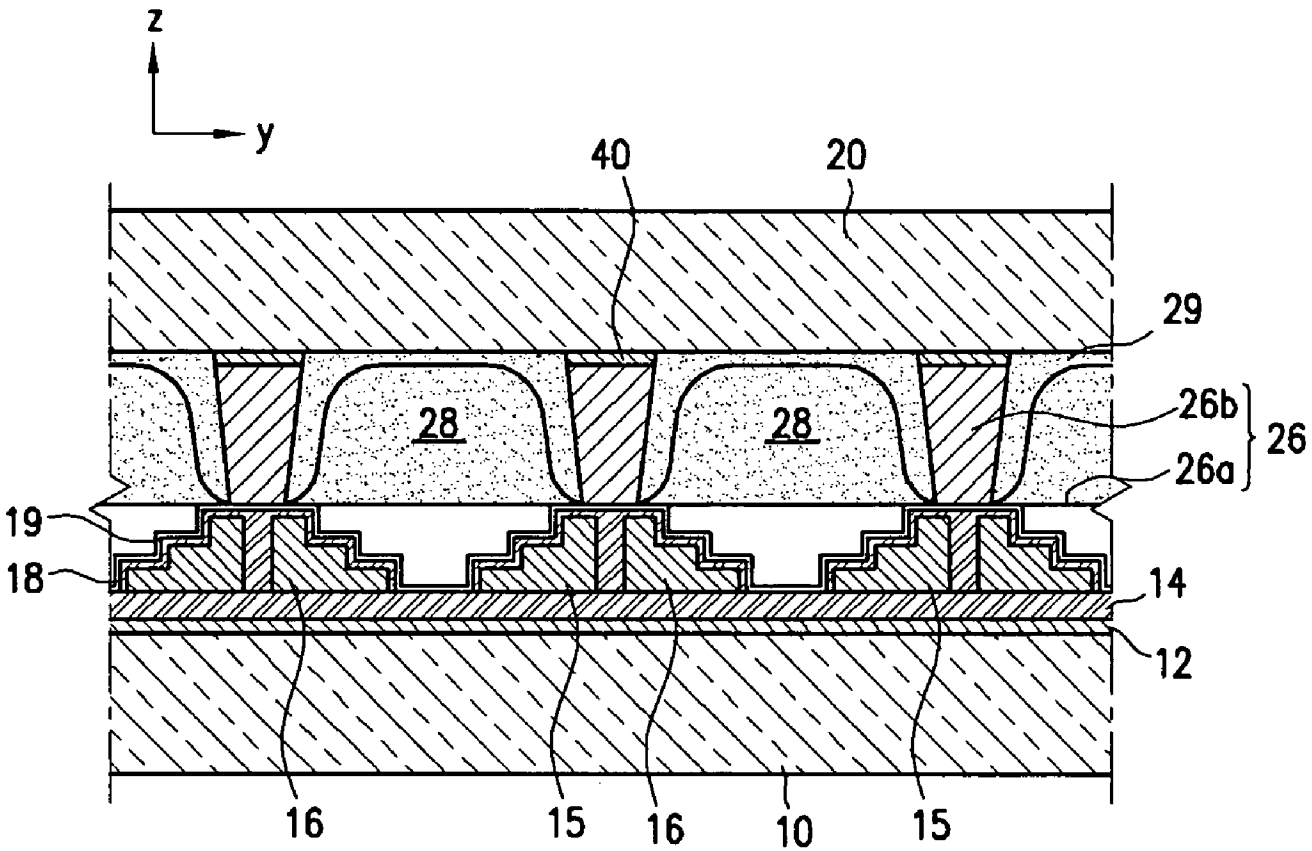
FIG. 10 is a partial cross-sectional view showing a fifth modification of the first embodiment of the present invention.

FIG. 10 is a partial cross-sectional view showing a fifth modification of the first embodiment of the present invention. As shown in FIG. 10, in the fifth modification, a black layer 40 is formed between the front substrate 20 and the barrier rib 26. The black layer 40 prevents the reflectance of external light and the contrast of the plasma display panel is enhanced.

In an alternative embodiment, if a dielectric layer (not shown) is formed on the front substrate 20, the black layer 40 may be formed on the dielectric layer between the barrier rib 26 and the dielectric layer. This configuration also falls within the scope of the embodiments of the present invention.

Figure 11:
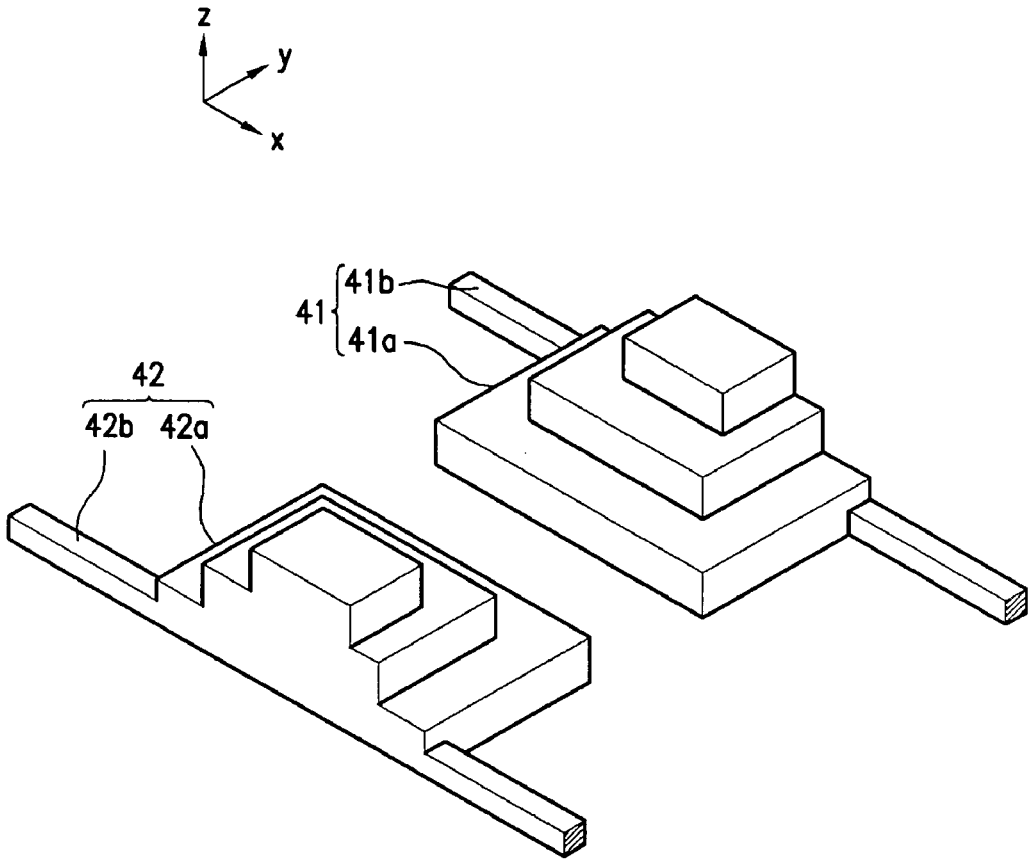
FIG. 11 is a partial perspective view showing a first electrode and a second electrode corresponding to each discharge cell in a sixth modification of the first embodiment of the present invention.

FIG. 11 is a partial perspective view showing a first electrode and a second electrode corresponding to each discharge cell in a sixth modification of the first embodiment of the present invention. In the sixth modification, a first and second electrode 41 and 42 include base portions 41*a* and 42*a* that are formed to correspond to the respective discharge cells and crossbar portions 41*b* and 42*b* that connect the base portions 41*a* and 42*a* in the second direction. The crossbar portions 41*b* and 42*b* of the first and second electrodes 41 and 42 are formed to connect the electrode layers on the rear substrate. The embodiments of the present invention are not limited to this configuration. For example, the crossbar portions may connect some of the base portions together in the second direction, but not all of the base portions. Similarly, the crossbar portions may connect some base portions near the rear substrate and others near the front substrate.

Figure 12:
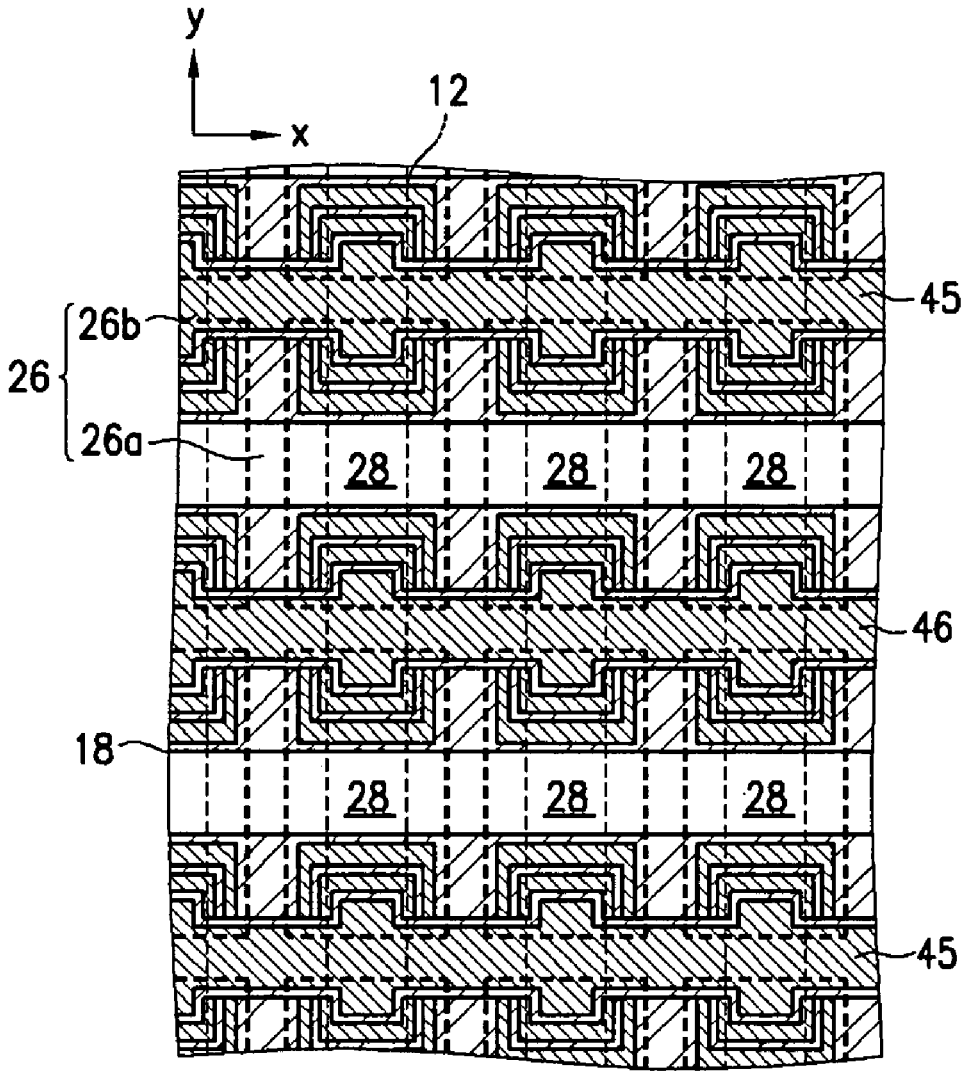
FIG. 12 is a partial plan view showing a seventh modification of the first embodiment of the present invention.

FIG. 12 is a partial plan view of a seventh modification of the first embodiment of the present invention. As shown in FIG. 12, in the seventh modification, a first electrode 45 and a second electrode 46 are formed to be shared by a pair of adjacent discharge cells 28 in the first direction. The first electrodes 45 and the second electrodes 46 correspond to the second barrier rib member 26*b*. The first electrode 45 and the second electrode 46 are alternately disposed in the first direction.

In consideration of certain environments of use for the plasma display panel, a pair of adjacent discharge cells 28 in the first direction may be driven as one subpixel or each discharge cell 28 may be driven as one subpixel.

Hereinafter, a plasma display panel according to a second embodiment of the present invention will be described. The second embodiment of the present invention has the same configuration as that in the first embodiment, except that the shapes of the first and second electrodes are different. In the second embodiment, the parts matching those in the first embodiment are represented by the same reference numerals and the descriptions thereof are omitted.

Figure 13:
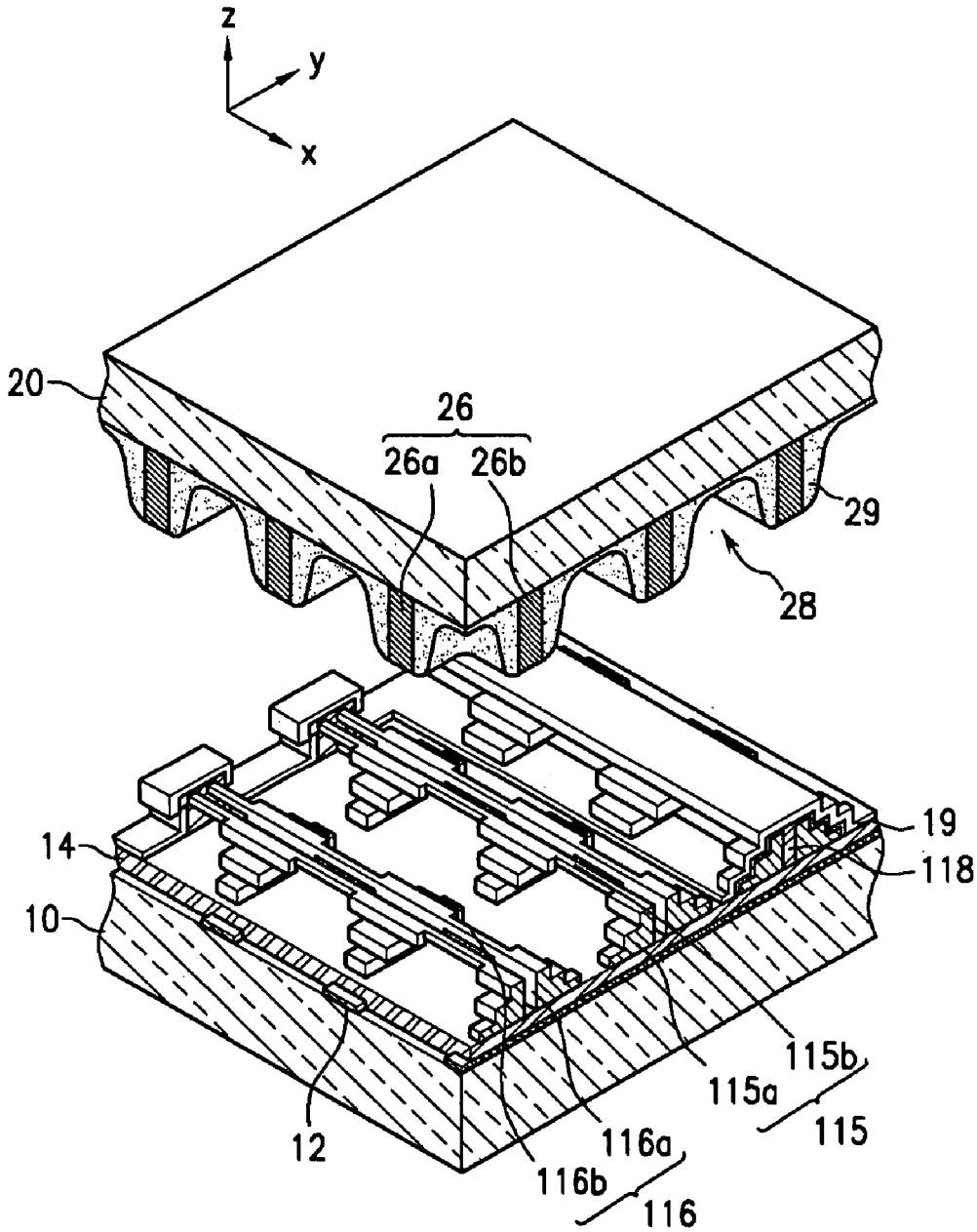
FIG. 13 is a partially exploded perspective view showing a plasma display panel according to a second embodiment of the present invention.
Figure 14:
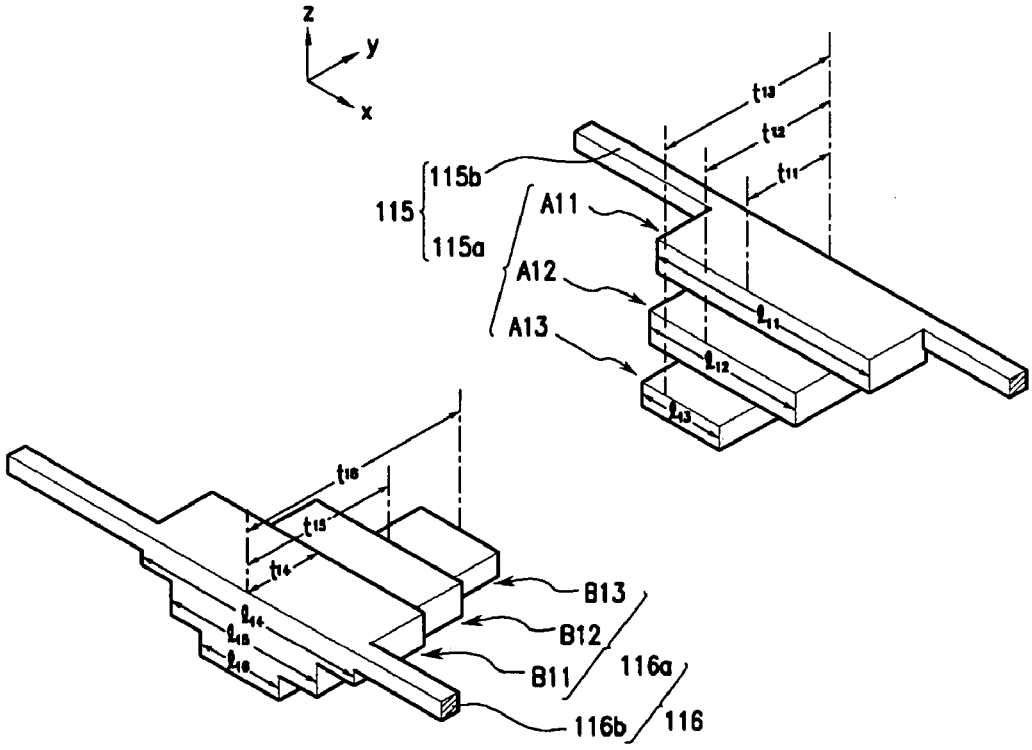
FIG. 14 is a partial perspective view showing a first electrode and a second electrode corresponding to each discharge cell in the second embodiment of the present invention.
Figure 15:
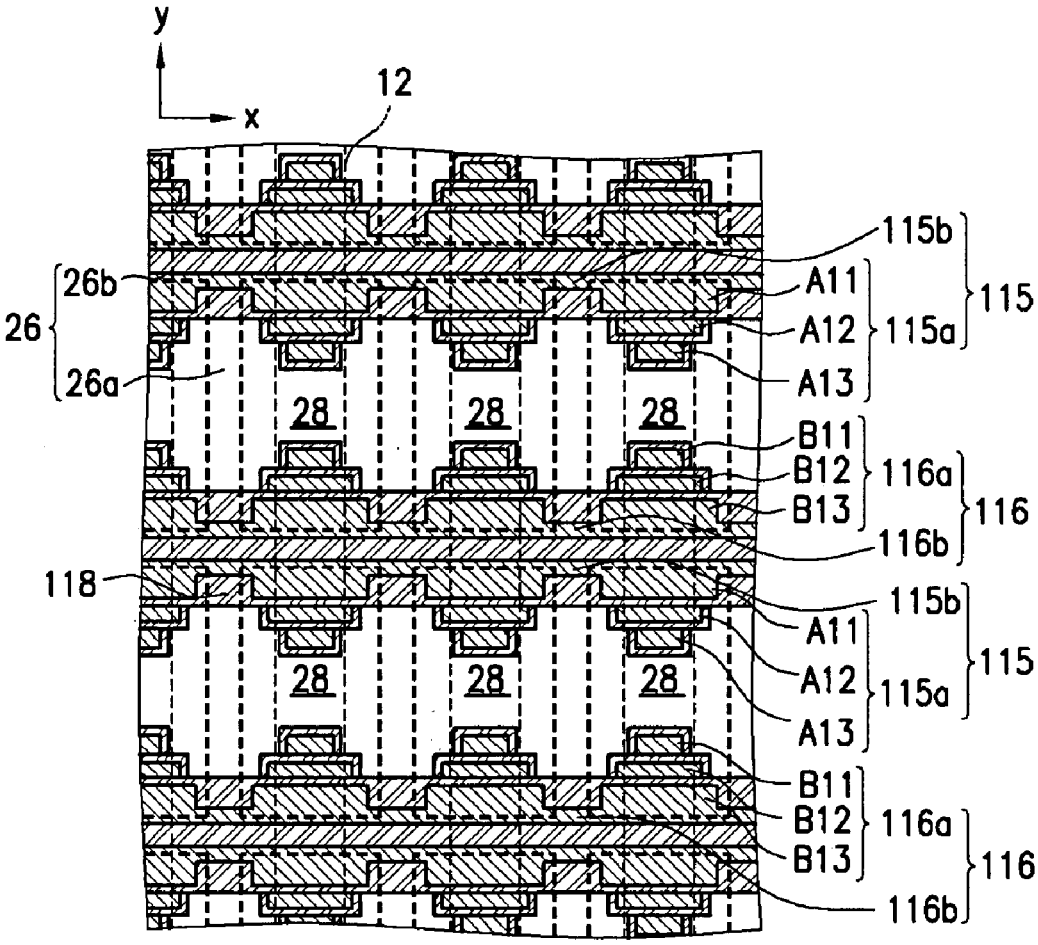
FIG. 15 is a partial plan view showing the plasma display panel according to the second embodiment of the present invention.

FIG. 13 is a partially exploded perspective view showing a plasma display panel according to the second embodiment of the present invention. FIG. 14 is a partial perspective view showing a first electrode and a second electrode corresponding to each discharge cell in the second embodiment of the present invention. FIG. 15 is a partial plan view showing the plasma display panel according to the second embodiment of the present invention.

Referring to FIG. 13, in the second embodiment, a first electrode 115 and a second electrode 116 include base portions 115*a* and 116*a* that are divided to correspond to the respective discharge cells 28, and a crossbar portions 115*b* and 116*b* that connect the base portions 115*a* and 116*a* in the second direction. The base portion 115*a* of the first electrode 115 and the base portion 116*a* of the second electrode 116 face each other with a space there between. The sustain discharge between the first electrode 115 and the second electrode 116 is induced as an opposed discharge and thus, the discharge firing voltage of the sustain discharge can be reduced.

The length of a portion of the base portions 115*a* and 116*a* near the first substrate 10 along the second direction is shorter than that of a portion of the base portions 115*a* and 116*a* near the front substrate 20.

The base portions 115*a* and 116*a* of the first and second electrodes 115 and 116 protrude more in the first direction near the rear substrate 10 than near the front substrate 20. Accordingly, the length of the base portions 115*a* and 116*a* of the first and second electrodes 115 and 116 along the first direction is longer near the rear substrate 10 than near the front substrate 20.

In the second embodiment, as shown in FIG. 14, the base portions 115*a* and 116*a* of the first and second electrodes 115 and 116 include at least two electrode layers, each having a different length and width. Though the base portions 115*a* and 116*a* may include three electrode layers in the second embodiment, the embodiments of the present invention are not limited to this configuration.

The base portion 115*a* of the first electrode 115 is structured so that $I_{12}$ is smaller than $I_{11}$ and $I_{13}$ is smaller than $I_{12}$. Here, $I_{11}$, $I_{12}$, and $I_{13}$ are lengths of an electrode layer A11, an electrode layer A12, and an electrode layer A13 of the base portion 115*a* of the first electrode 115 in the second direction. The base portion 116*a* of the second electrode 116 is structured so that $I_{15}$ is smaller than $I_{14}$ and $I_{16}$ is larger than $I_{15}$. Here, $I_{14}$, $I_{15}$, and $I_{16}$ are lengths of an electrode layer B11, an electrode layer B12, and an electrode layer B13 of the base portion 116*a* of the second electrode 116 in the second direction.

The length of the base portions 115*a* and 116*a* in the second direction decreases stepwise from the electrode layers A11 and B11 near the front substrate 20 to the electrode layers A13 and B13 near the rear substrate 10. If all the electrode layers A11, A12, and A13, and B11, B12, and B13 are formed, the cross-section of the base portions 115*a* and 116*a* along the direction perpendicular to the first direction has a step shape in which the length decreases stepwise from the front substrate 20 to the rear substrate 10.

The base portion 115*a* of the first electrode 115 is structured so that $t_{12}$ is larger than $t_{11}$ and $t_{13}$ is larger than $t_{12}$. Here, $t_{11}$, $t_{12}$, and $t_{13}$ are widths of the electrode layer A11, the electrode layer A12, and the electrode layer A13 of the base portion 115*a* of the first electrode 115 in the first direction. The base portion 116*a* of the second electrode 116 is structured so that $t_{15}$ is larger than $t_{14}$ and $t_{16}$ is larger than $t_{15}$. Here, $t_{14}$, $t_{15}$, and $t_{16}$ are lengths of the electrode layer B11, the electrode layer B12, and the electrode layer B13 of the base portion 116*a* of the second electrode 116 in the first direction.

The width of the base portions 115*a* and 116*a* of the first and second electrodes 115 and 116 in the first direction increases stepwise from the electrode layers A11 and B11 near the front substrate 20 to the electrode layers A13 and B13 near the rear substrate 10. If all the electrode layers A11, A12, and A13, and B11, B12, and B13 are formed, the cross-section of the base portions 115*a* and 116*a* along the direction perpendicular to the second direction has a step shape in which the width increases stepwise from the front substrate 20 to the rear substrate 10.

The base portions 115*a* and 116*a* of the first and second electrodes 115 and 116 may have a different number of electrode layers. The lengths and widths of the respective layers along the first direction or the second direction may be different. These alternative embodiments also fall within the scope of the present invention.

In one embodiment of the present invention, the first electrodes 115 and the second electrodes 116 are disposed to be sequentially repeated in a pair of adjacent discharge cells 28 in the first direction. For example, the order of the electrodes may be a first electrode 115, followed by a second electrode 116, then a first electrode 115, and finally a second electrode 116.

A second dielectric layer 118 is formed to surround the first and second electrodes 115 and 116. As shown in FIG. 15, the second dielectric layer 118 is formed to extend along the second direction while surrounding the first and second electrodes 115 and 116.

In the second embodiment, the first and second electrodes 115 and 116 protrude toward each other more near the rear substrate 10. Thus, the first electrode 115 and the second electrode 116 have a short gap near the rear substrate 10 and have a long gap near the front substrate 20. Accordingly, the discharge is fired across the short gap near the rear substrate 10 and is diffused across the long gap close to the front substrate 20. Therefore, the discharge firing voltage can be reduced and the discharge efficiency can be enhanced.

The length of each of the base portions 115*a* and 116*a* along the first direction near the first substrate 10 (rear substrate) is greater than that of each base portions 115*a* and 116*a* near the second substrate 20 (front substrate), such that a weak short gap discharge can be induced and an intense long gap discharge can be induced. That is, in the second embodiment, with the intense long gap discharge, the discharge efficiency can be enhanced.

Hereinafter, modifications of the second embodiment of the present invention will be described. The modifications of the second embodiment have the same basic configuration as that of the second embodiment and the parts in the modifications are represented by the same reference numerals as the corresponding parts in the second embodiment.

Figure 16:
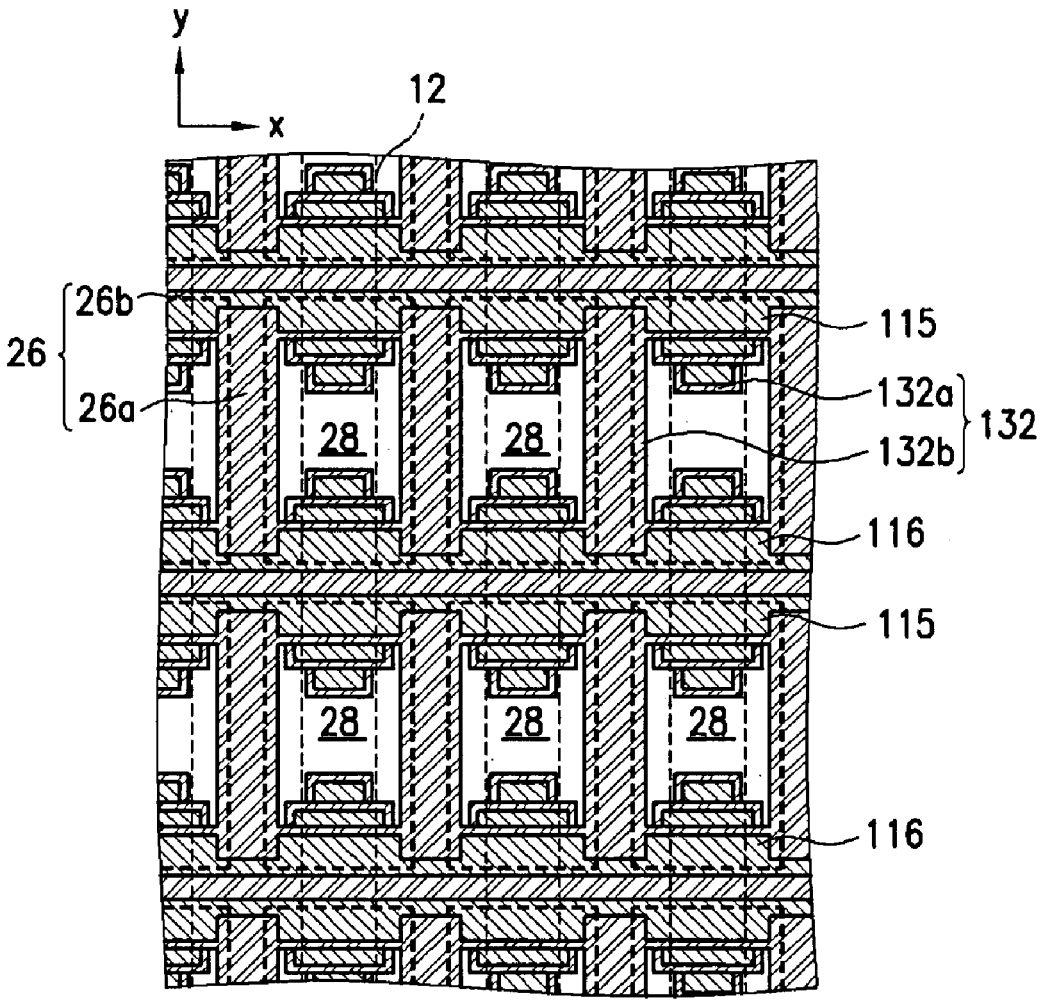
FIG. 16 is a partial plan view showing a first modification of the second embodiment of the present invention.

FIG. 16 is a partial plan view showing a first modification of the second embodiment of the present invention. In the first modification, a second dielectric layer 132 has a first dielectric layer portion 132*a* that is formed in the second direction to surround the first and second electrodes 115 and 116 and a second dielectric layer portion 132*b* that is formed in the first direction. The second dielectric layer portion 132*b* allows the discharge in the respective discharge cells to be controlled more accurately.

Figure 17:
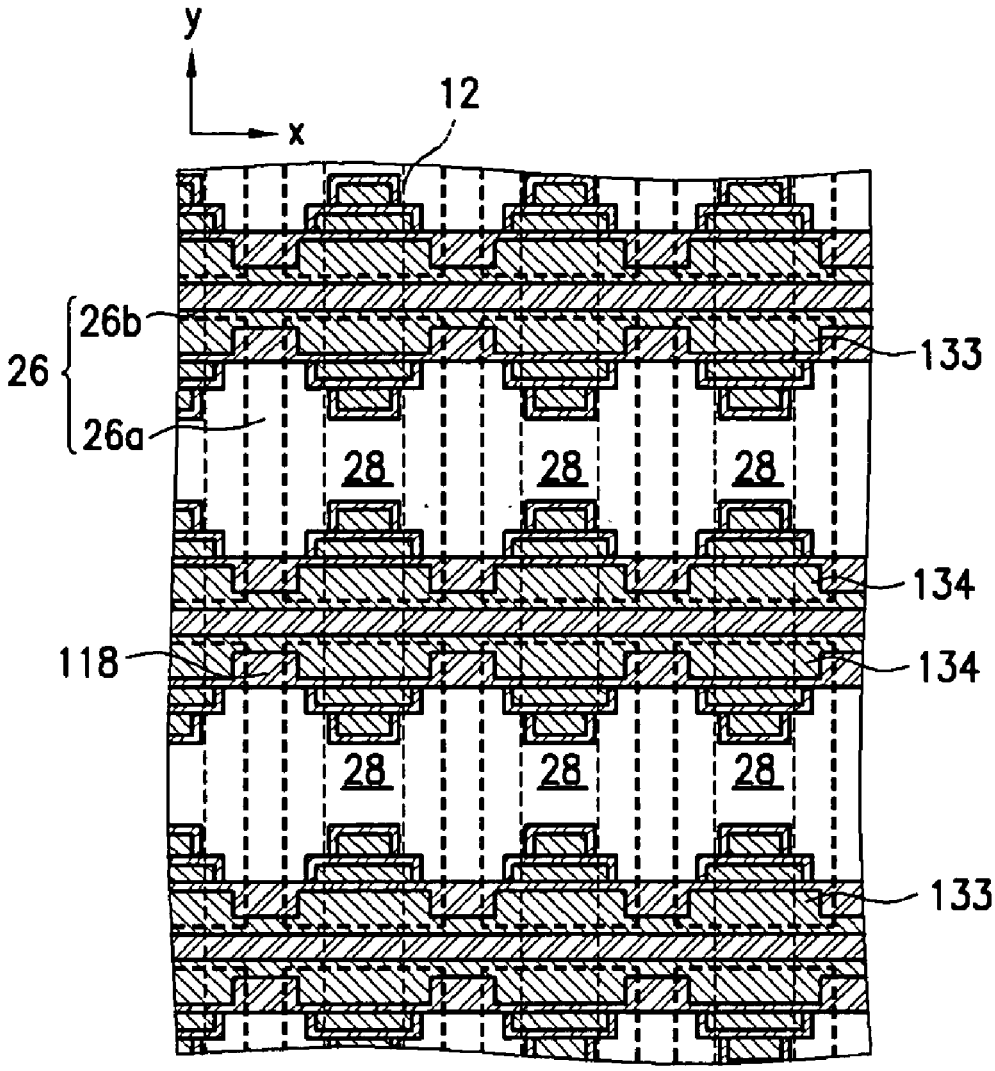
FIG. 17 is a partial plan view showing a second modification of the second embodiment of the present invention.

FIG. 17 is a partial plan view of a second modification of the second embodiment of the present invention.

In the second modification, first and second electrodes 133 and 134 are disposed in adjacent discharge cells 28 in the first direction in a repeating order. The order may include first electrodes 133 adjacent to other first electrodes 133 and second electrodes 134 adjacent to other second electrodes 134. For example, a first electrode 133 may be followed by a second electrode 134, then another second electrode 134, and finally a first electrode 133.

Figure 18:
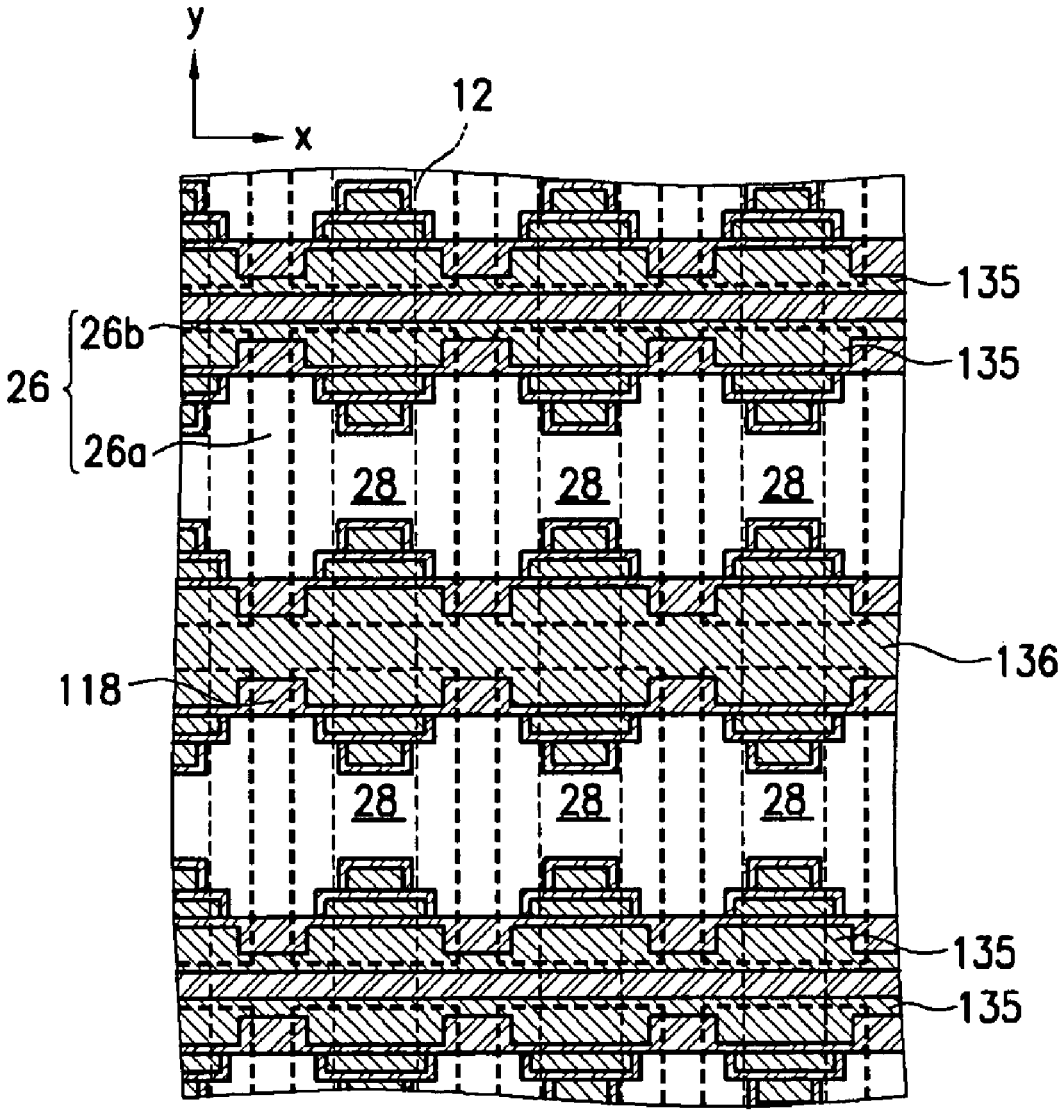
FIG. 18 is a partial plan view showing a third modification of the second embodiment of the present invention.

FIG. 18 is a partial plan view showing a third modification of the second embodiment of the present invention.

In the third modification, a second electrode 136 is formed to be shared by adjacent discharge cells 28 in the first direction. In the third modification, for example, an address discharge is generated by applying a voltage to a first electrode 135 and an address electrode 12. A sustain discharge is generated by alternately applying a voltage to the first electrode 135 and the second electrode 136.

Figure 19:
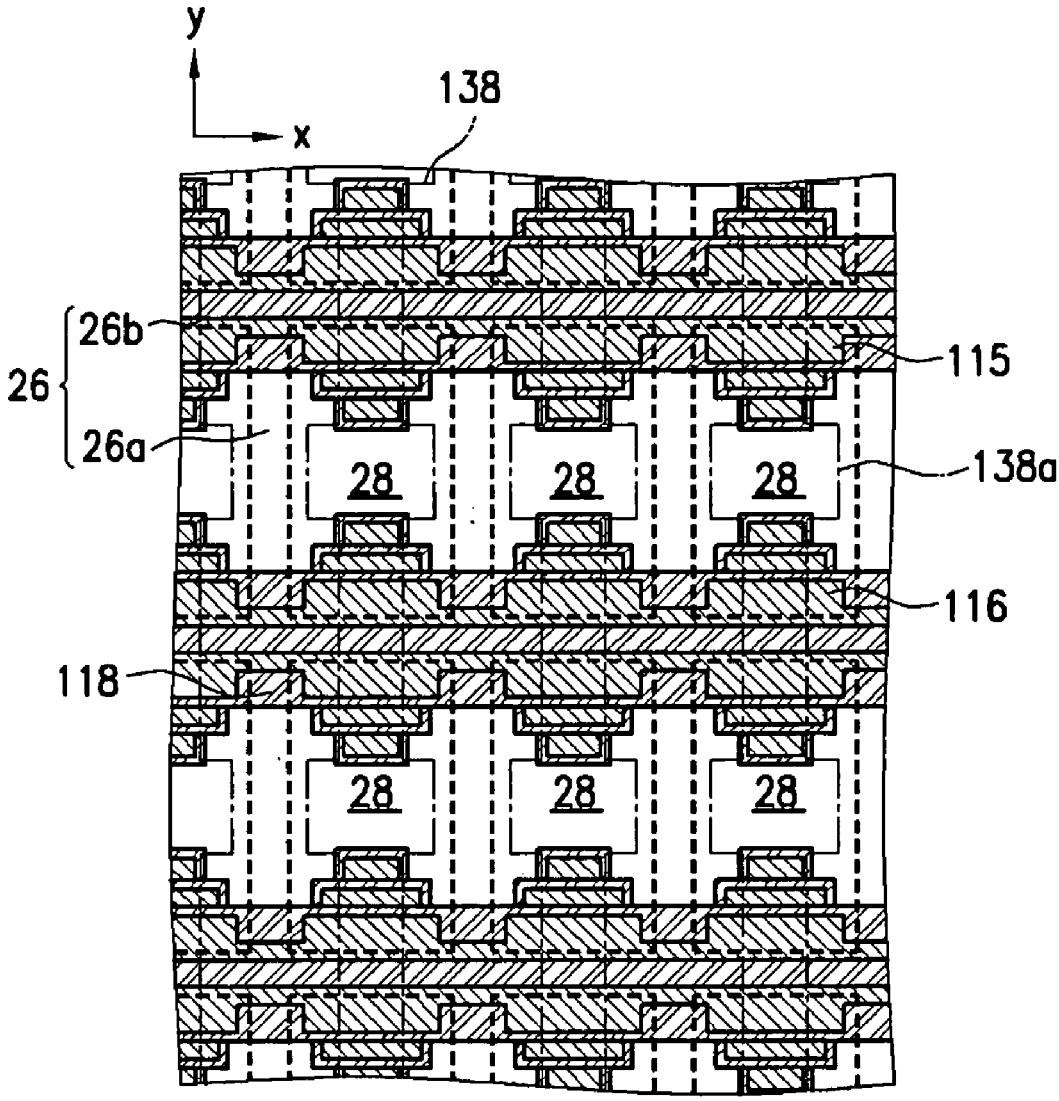
FIG. 19 is a partial plan view showing a fourth modification of the second embodiment of the present invention.

FIG. 19 is a partial plan view showing a fourth modification of the second embodiment of the present invention. As shown in FIG. 19, in the fourth modification, a protruding portion 138*a* is formed in a portion of an address electrode 138 corresponding to a space between the first electrode 115 and the second electrode 116. Accordingly, in the fourth modification, the efficiency of the address discharge can be enhanced.

Figure 20:
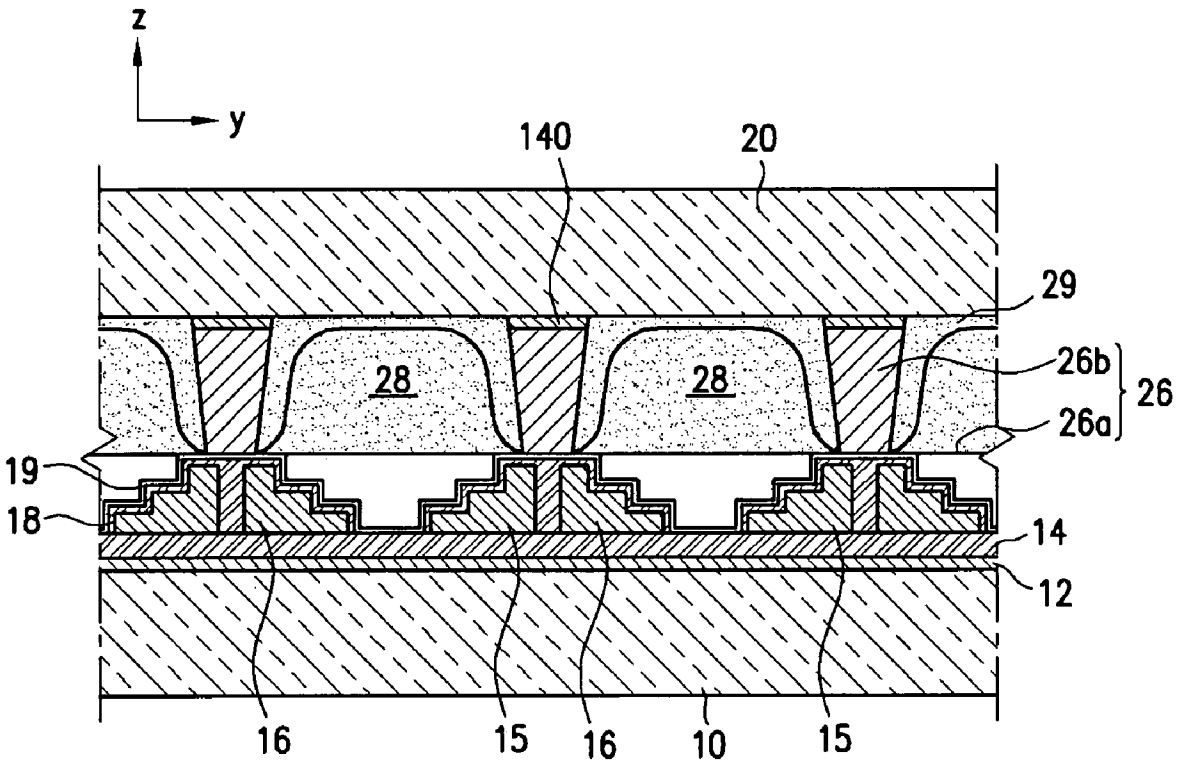
FIG. 20 is a partial cross-sectional view showing a fifth modification of the second embodiment of the present invention.

FIG. 20 is a partial cross-sectional view showing a fifth modification of the second embodiment of the present invention.

As shown in FIG. 20, in the fifth modification, a black layer 140 is formed on the front substrate 20 between the front substrate 20 and the barrier rib 26. Such a black layer 140 prevents the reflectance of external light and thus enhances the contrast of the plasma display panel.

Figure 21:
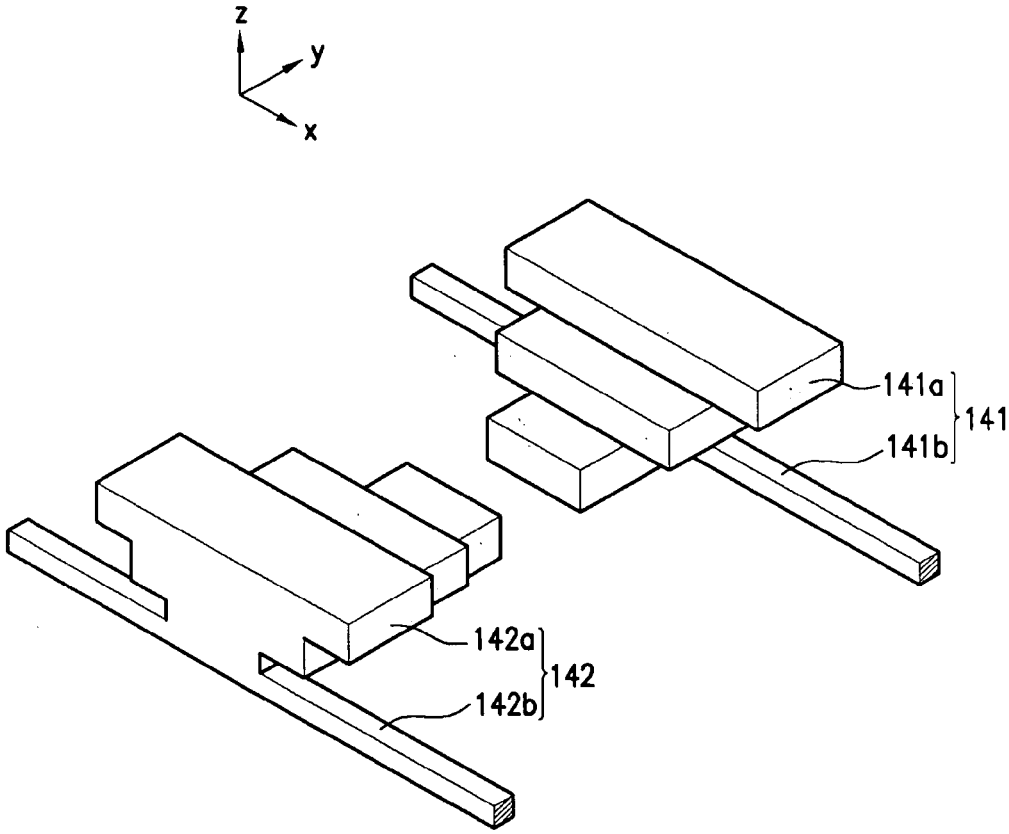
FIG. 21 is a partial perspective view showing a first electrode and a second electrode corresponding to a discharge cell in a sixth modification of the second embodiment of the present invention.

FIG. 21 is a partial perspective view showing a first electrode and a second electrode corresponding to each discharge cell in a sixth modification of the second embodiment of the present invention.

In the sixth modification, crossbar portions 141*b* and 142*b* that connect base portions 141*a* and 142*a* to other base portions are connected to the electrode layers on the rear substrate along the second direction.

Figure 22:
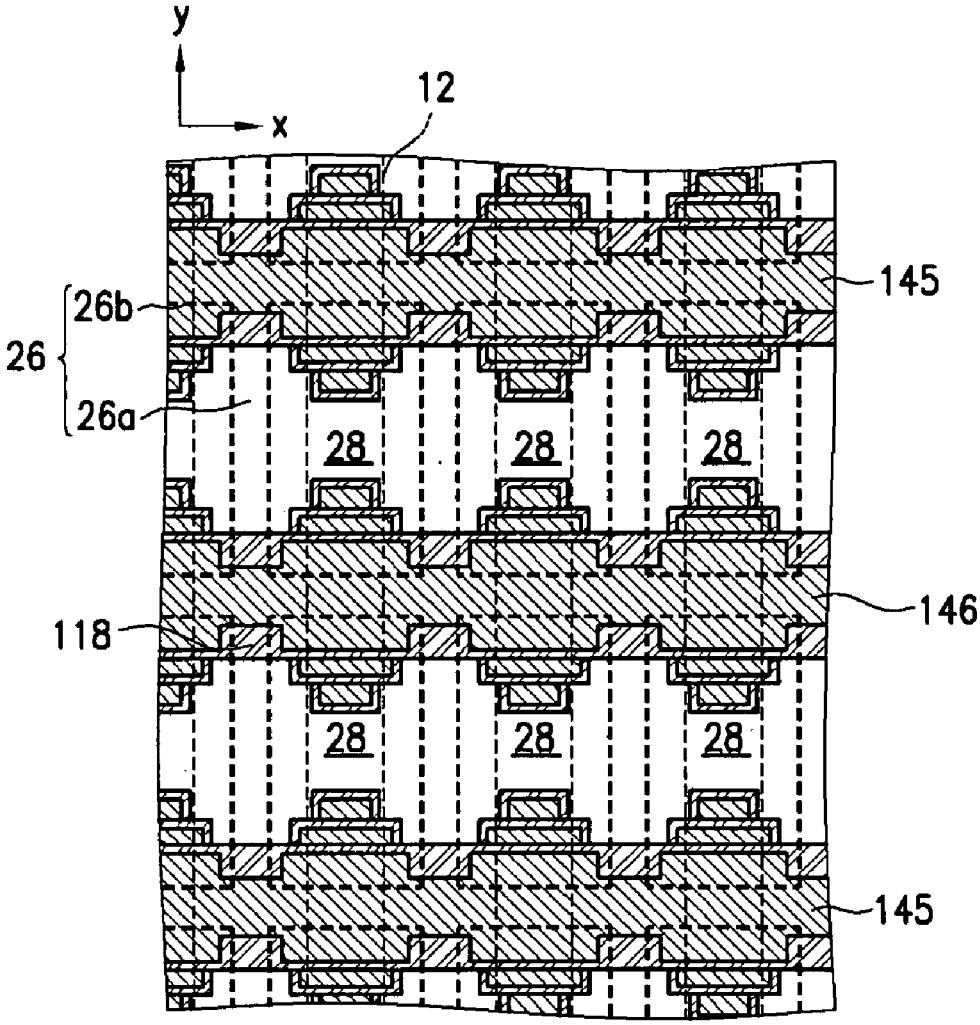
FIG. 22 is a partial plan view showing a seventh modification of the second embodiment of the present invention.

FIG. 22 is a partial plan view of a seventh modification of the second embodiment of the present invention.

As shown in FIG. 22, in the seventh modification, a first electrode 145 and a second electrode 146 are formed to be shared by a pair of adjacent discharge cells in the first direction. Further, the first and second electrodes 145 and 146 are alternately disposed in the first direction. A pair of adjacent discharge cells 28 in the first direction may constitute one subpixel or each discharge cell 28 may constitute one subpixel. Although the present invention has been described with reference to certain exemplary embodiments and modifications thereof, it will be understood by those skilled in the art that a variety of modifications and variations may be made to the exemplary embodiments of the present invention without departing from the spirit or scope of the present invention defined in the appended claims, and their equivalents.

What is claimed is:

1. A plasma display panel comprising:

a first substrate and a second substrate disposed to face each other at a predetermined distance, a space between the first substrate and the second substrate being divided into discharge cells;

phosphor layers formed in the discharge cells;

address electrodes that are formed on the first substrate in a first direction; and first electrodes and second electrodes that are formed in a second direction crossing the first direction, the first electrodes and second electrodes being electrically isolated from the address electrodes and corresponding to the discharge cells, wherein the first electrodes and the second electrodes have base portions to correspond to discharge spaces of the discharge cells, and a crossbar portion that connects the base portions along the second direction, wherein at least one of the base portions of the first electrodes and at least one of the base portions of the second electrodes face each other across a gap in the discharge cells, and wherein a length in the second direction of a portion of each base portion near the first substrate is different from a length of a portion of each base portion near the second substrate.

2. The plasma display panel of claim 1, wherein the length in the second direction of the portion of each base portion near the first substrate is longer than the length of the portion of each base portion near the second substrate.

3. The plasma display panel of claim 1, wherein the length in the second direction of the portion of each base portion near the first substrate is shorter than the length of the portion of each base portion near the second substrate.

4. The plasma display panel of claim 1, wherein each portion of the base portion near the first substrate protrude toward the center of each discharge cell more than each portion of the base portion near the second substrate.

5. A plasma display panel comprising:

a first substrate and a second substrate that are disposed to face each other at a predetermined distance, a space between the first substrate and the second substrate being divided into a plurality of discharge cells;

phosphor layers that are formed in the discharge cells;

address electrodes that are formed on the first substrate in a first direction; and first electrodes and second electrodes that are formed in a second direction crossing the first direction, the first electrodes and the second electrodes being electrically isolated from the address electrodes and corresponding to the discharge cells, wherein the first electrodes and the second electrodes have base portions to correspond to discharge spaces of the discharge cells, and a crossbar portion that connects the base portions along the second direction, wherein at least one of the base portions of the first electrodes and at least one of the base portions of the second electrodes face each other across a gap in the discharge cells, and wherein the base portions include at least two electrode layers having different lengths in one of the first direction and the second direction.

6. The plasma display panel of claim 5, wherein the at least two electrode layers become longer stepwise toward the first substrate in the second direction.

7. The plasma display panel of claim 5, wherein the at least two electrode layers become shorter stepwise toward the first substrate in the second direction.

8. The plasma display panel of claim 5, wherein the at least two electrode layers protrude more toward the center of each of the discharge cells stepwise toward the first substrate.

9. The plasma display panel of claim 5, wherein an electrode layer of the at least two electrode layers close to the first substrate is wider than another electrode layer of the at least two electrode layers close to the second substrate.

10. The plasma display panel of claim 5, wherein the crossbar portion connects the at least two electrode layers close to the second substrate along the second direction.

11. The plasma display panel of claim 5, wherein the crossbar portion connects the at least two electrode layers close to the first substrate along the second direction.

12. The plasma display panel of claim 5, further comprising:

a first dielectric layer that is formed on the first substrate to cover the address electrodes; and a second dielectric layer that surrounds the first electrodes and the second electrodes to form a space between the first electrodes and the second electrodes.

13. The plasma display panel of claim 12, wherein the second dielectric layer extends along the second direction to surround the first electrodes and second electrodes.

14. The plasma display panel of claim 12, wherein the second dielectric layer includes a first dielectric layer portion that is formed along the second direction to surround the first electrodes and the second electrodes and a second dielectric layer portion that is formed along the first direction.

15. The plasma display panel of claim 5, wherein at least one of the first electrodes and the second electrodes is shared by a pair of adjacent ones of the discharge cells in the first direction.

16. The plasma display panel of claim 15, wherein the first electrodes and second electrodes are shared by the pair of adjacent ones of the discharge cells in the first direction, and wherein the first electrodes and the second electrodes are alternately disposed in the first direction.

17. The plasma display panel of claim 5, wherein barrier ribs are disposed between the first electrodes and the second electrodes and the second substrate to divide the plurality of discharge cells.

18. The plasma display panel of claim 17, wherein black layers are formed on the second substrate to correspond to the barrier ribs.

19. The plasma display panel of claim 5, wherein the phosphor layers are formed on the second substrate.

20. The plasma display panel of claim 5, wherein the address electrode has protruding portions that extend in the second direction to correspond to a space between the first electrode and the second electrode.

* * * * *